US005323754A

United States Patent [19]

Pittman et al.

[11] Patent Number: 5,323,754

[45] Date of Patent: Jun. 28, 1994

[54] STRAP ASSEMBLY FOR BOW STRING RELEASE MECHANISM

[75] Inventors: Johnny Pittman, Breedsville, Mich.; Lynn A. Tentler, Fond du Lac, Wis.

[73] Assignee: Tru Fire Corporation, N. Fond du Lac, Wis.

[21] Appl. No.: 761,722

[22] Filed: Sep. 18, 1991

[51] Int. Cl.[5] ..... F41B 5/18

[52] U.S. Cl. ..... 124/35.2; 124/35.1; 24/306; 2/170

[58] Field of Search ..... 124/35.2, 35.1, 31, 124/90, 91; 24/306, 442, 15; 2/170, 161 A, 162, 17; 602/64

[56] References Cited

U.S. PATENT DOCUMENTS

| | | | |
|---|---|---|---|
| 2,929,372 | 3/1960 | Vance | 124/35.1 |
| 2,996,059 | 8/1961 | Vance | 124/35.2 |
| 3,004,532 | 10/1961 | Vance | 124/35.2 X |
| 3,028,852 | 4/1962 | Sutton, Jr. | 124/35.2 |
| 3,072,115 | 1/1963 | Johnson | 124/35.2 |
| 3,815,908 | 6/1974 | Hashimoto | 2/161.9 X |
| 4,047,250 | 9/1977 | Norman | 2/170 X |
| 4,193,135 | 3/1980 | Ryee | 2/162 |
| 4,426,989 | 1/1984 | Sutton | 124/35.2 |
| 4,509,497 | 4/1985 | Garvison | 124/35.2 |
| 4,831,997 | 5/1989 | Greene | 124/35.2 |
| 4,938,487 | 7/1990 | Ponsart | 2/161.4 X |
| 4,981,128 | 1/1991 | Garvison | 124/35.2 |
| 5,014,689 | 5/1991 | Meunchen et al. | 2/161 A X |

*Primary Examiner*—Randolph A. Reese
*Assistant Examiner*—Harry C. Kim
*Attorney, Agent, or Firm*—Robert C. Curfiss

[57] ABSTRACT

A strap assembly for securing a bow string release mechanism to the hand of an archer includes a substantially rigid base to be held in the palm of the hand with the bow string release mechanism projecting outwardly from the base through the space between the thumb and forefinger and a strap secured to the base for wrapping around the hand of the archer to secure the base to the hand. The base may be foldable over the strap to remove the base and bow string release mechanism from the palm of the hand for freeing the hand of the archer for other functions without removing the strap assembly.

24 Claims, 14 Drawing Sheets

FIG. 4
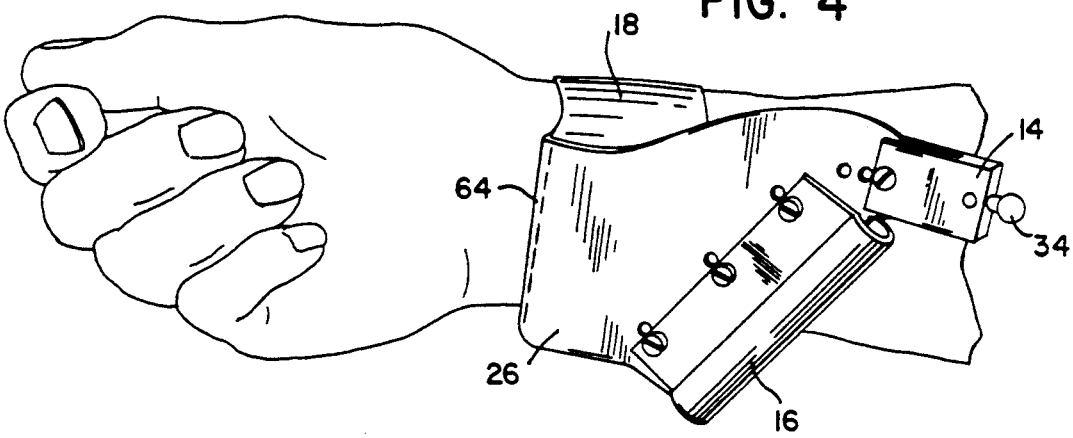
FIG. 5
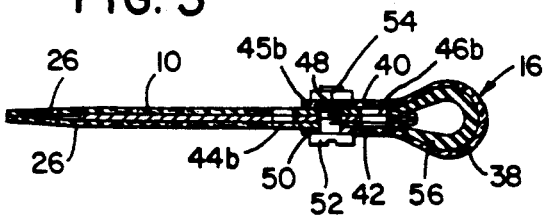
FIG. 6
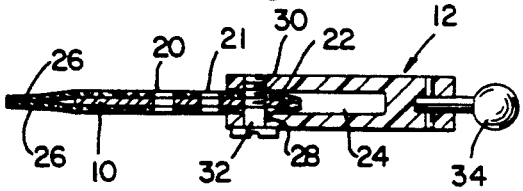
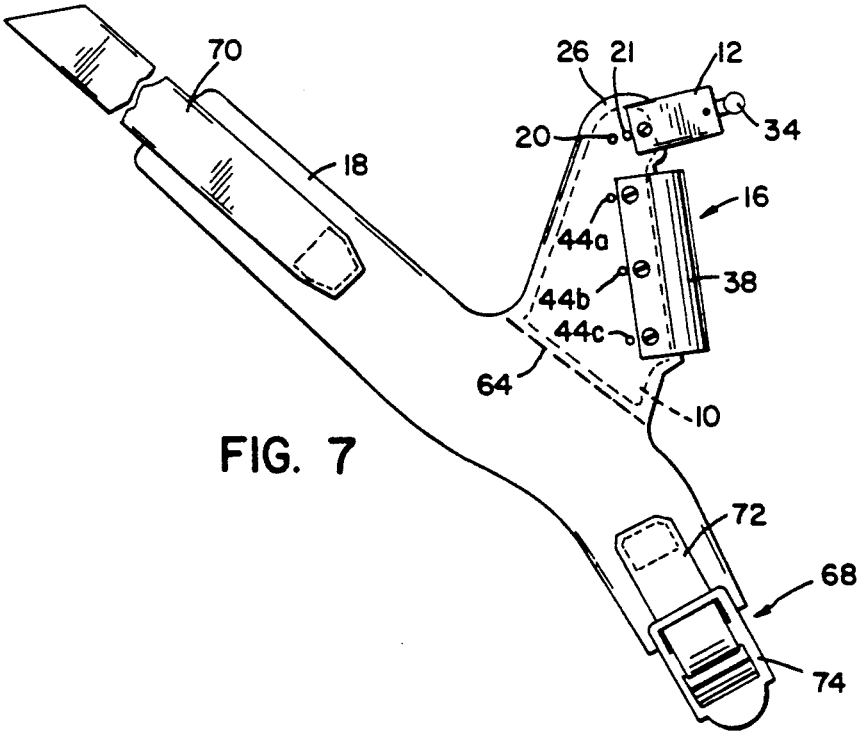
FIG. 7

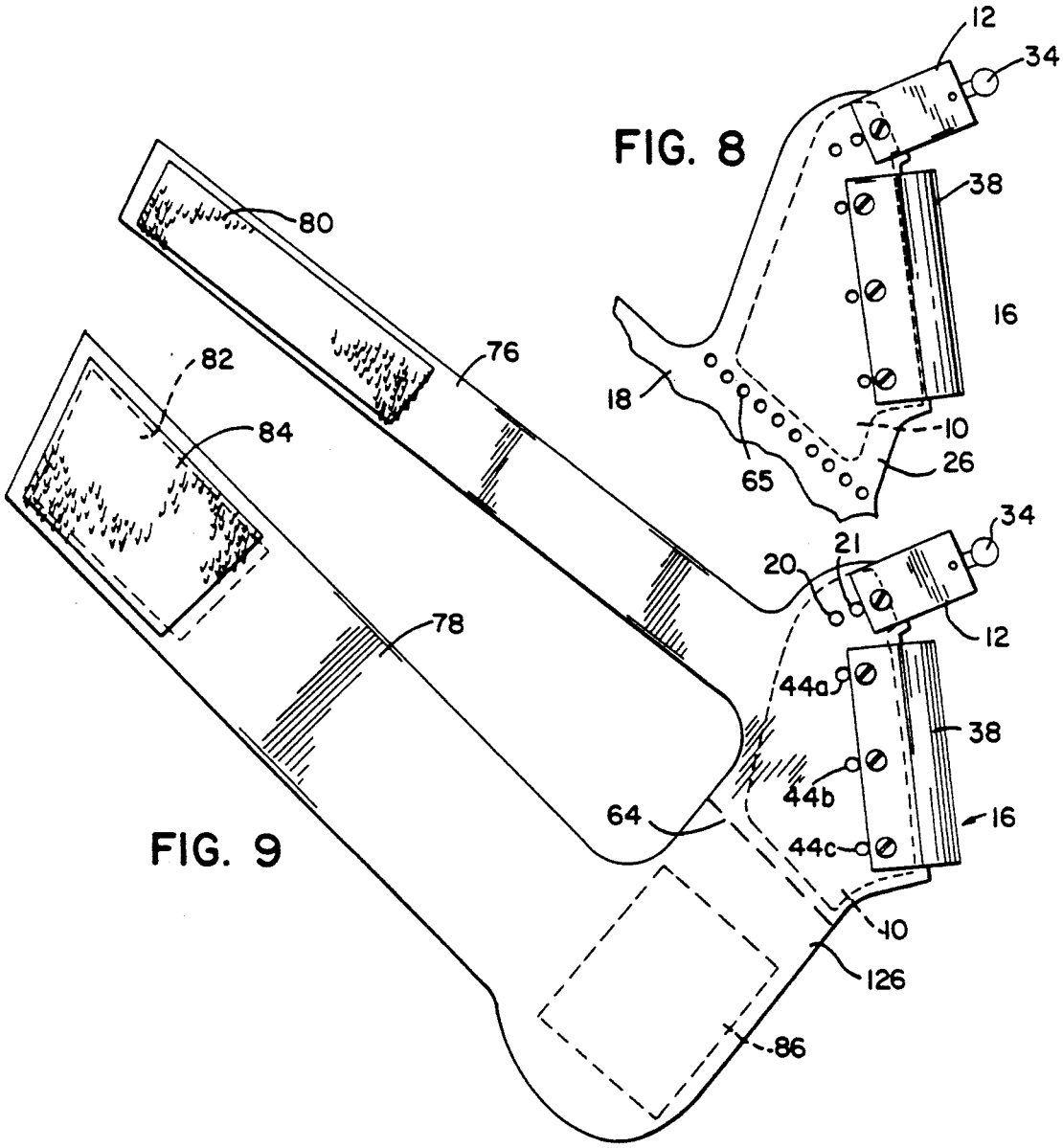
FIG. 8
FIG. 9
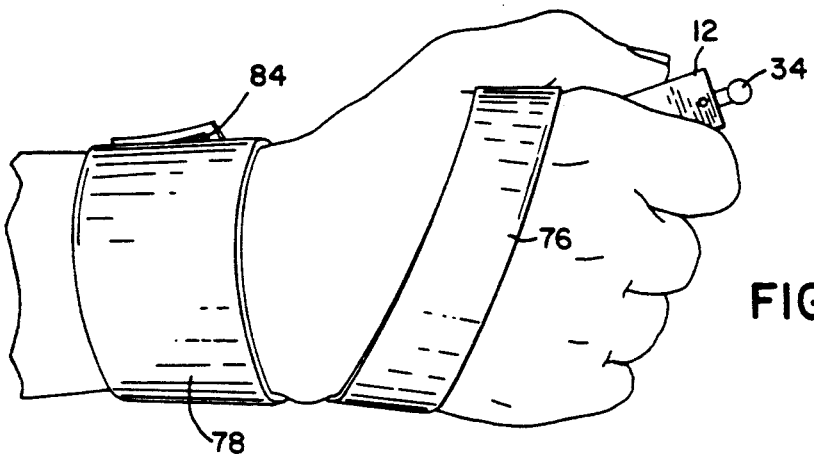
FIG. 10

FIG. 11
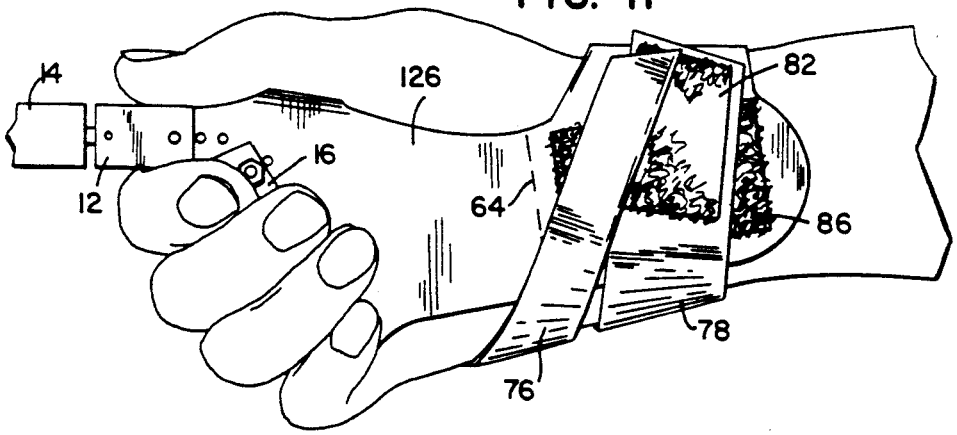
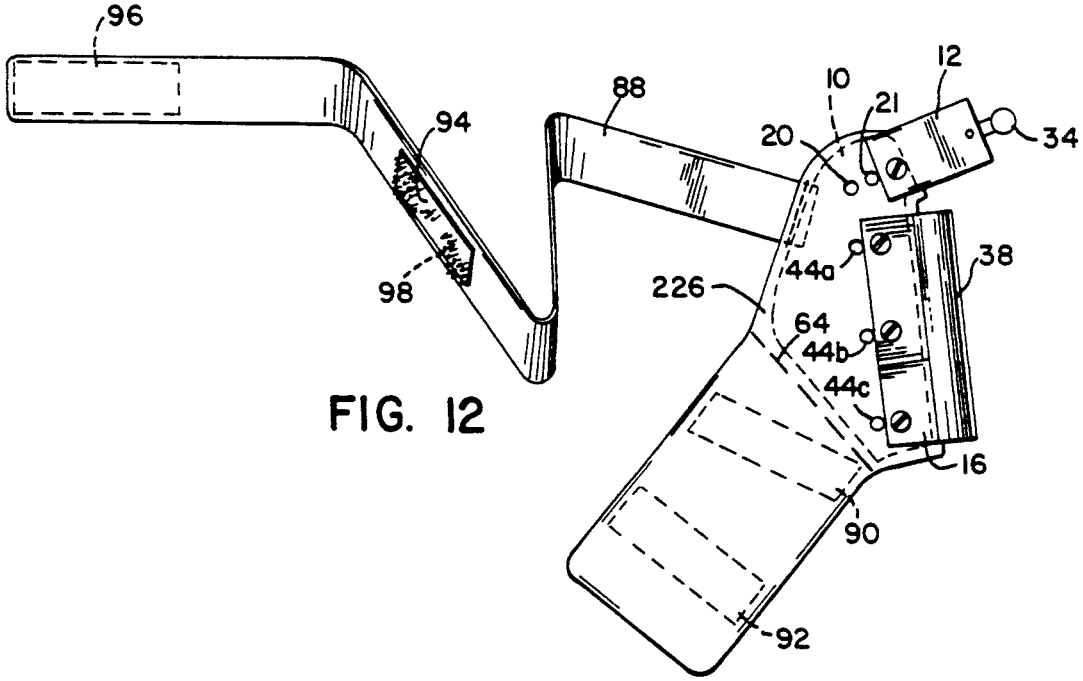
FIG. 12
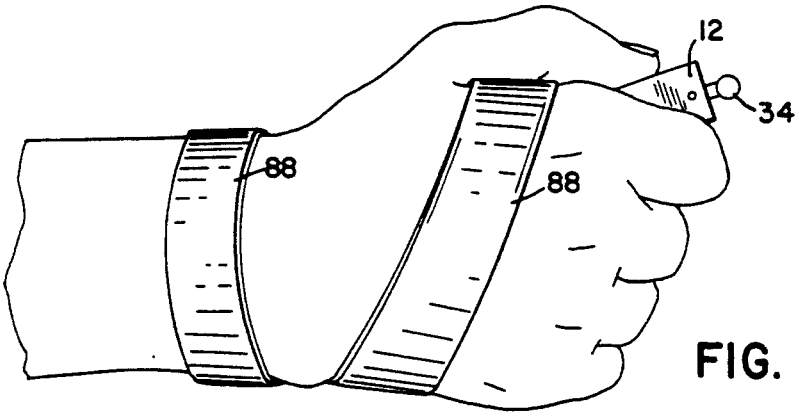
FIG. 13

FIG. 14
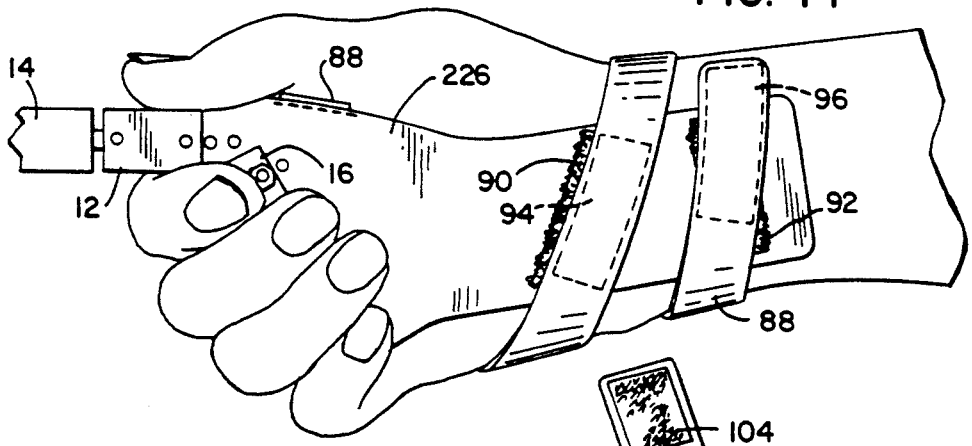
FIG. 15
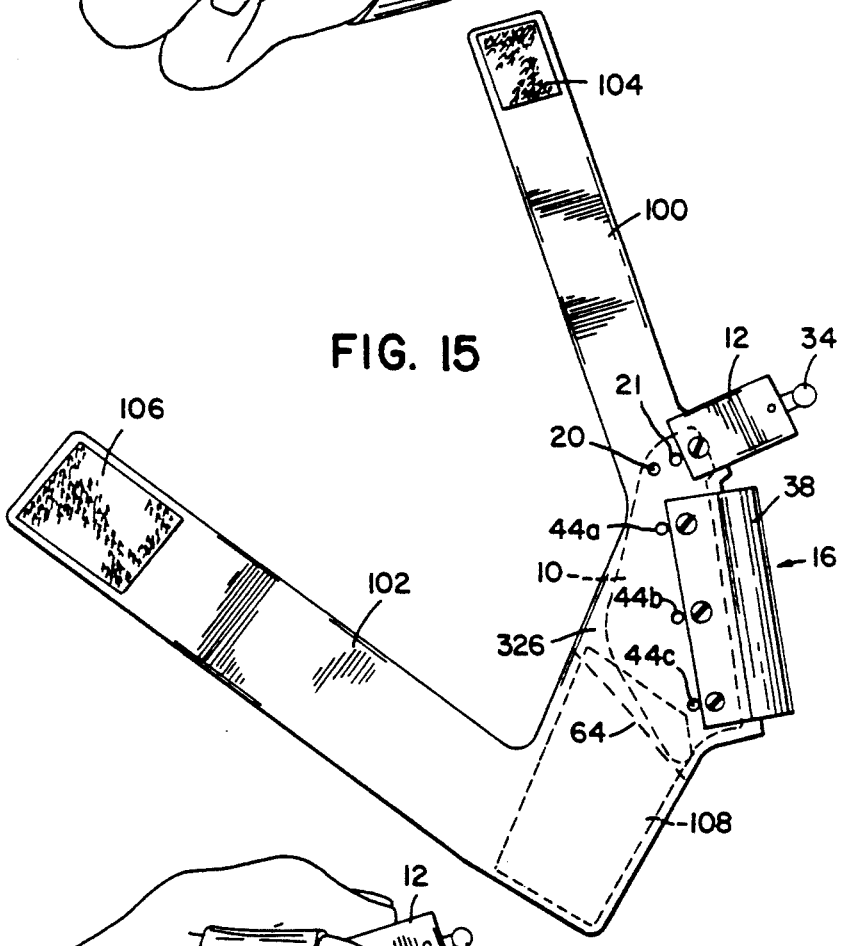
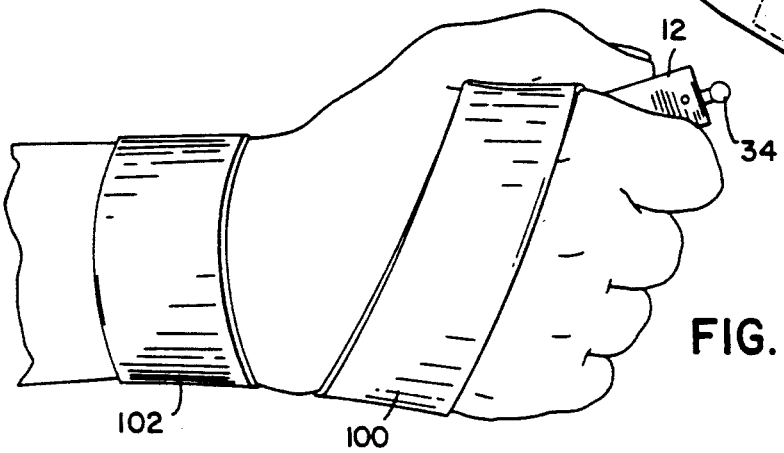
FIG. 16

FIG. 17
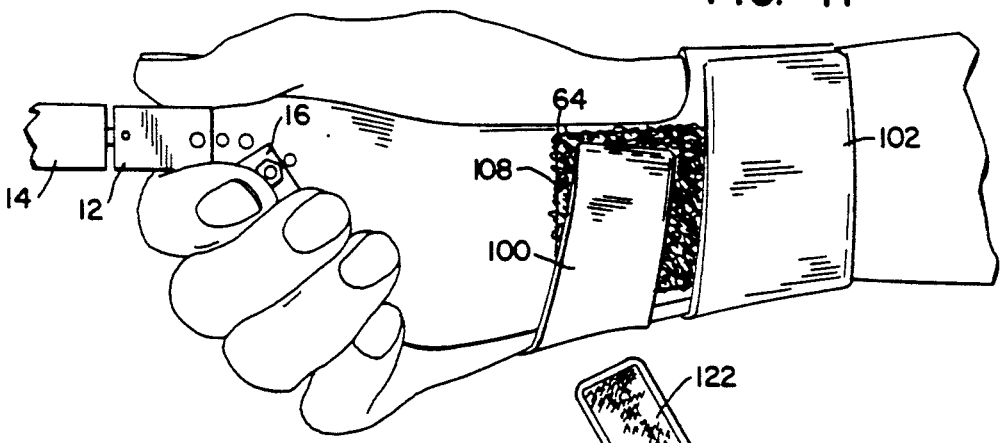
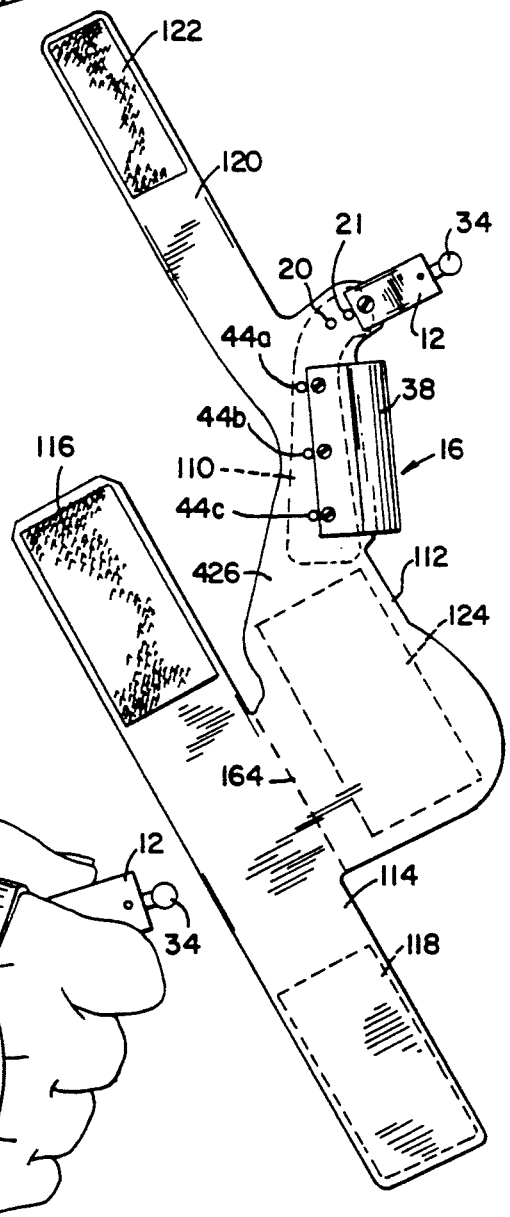
FIG. 18
FIG. 19
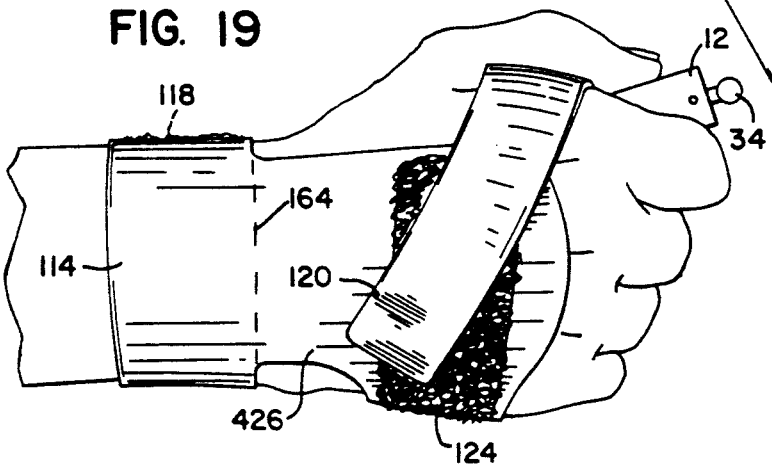

FIG. 20
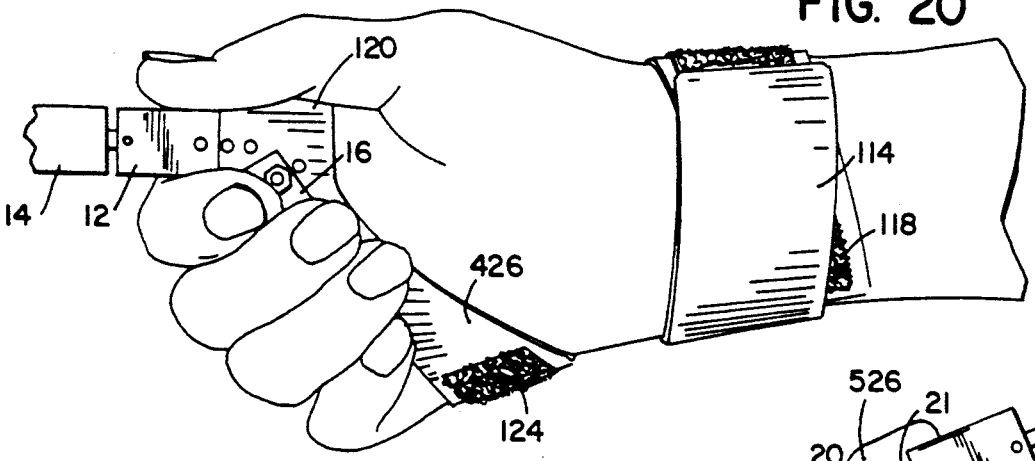
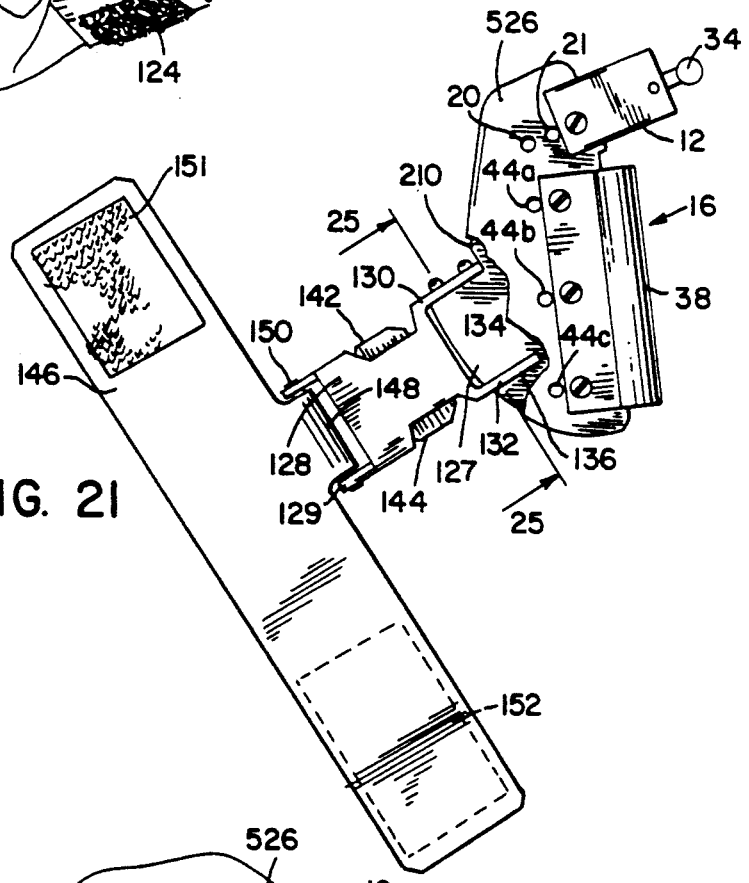
FIG. 21
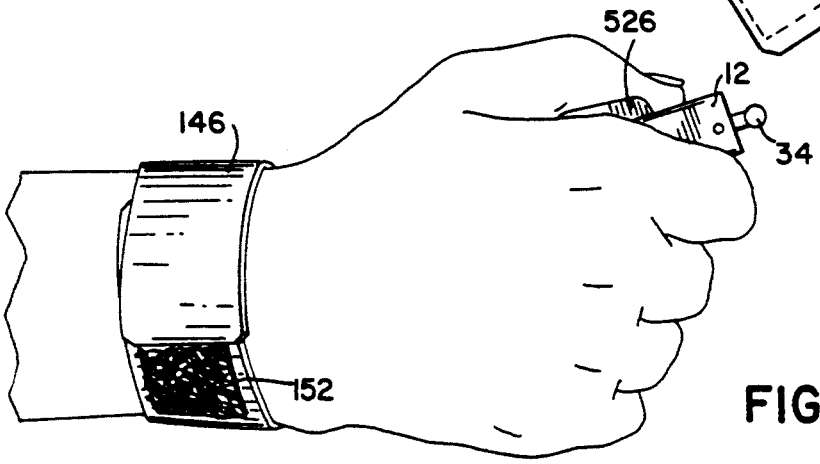
FIG. 22

FIG. 23
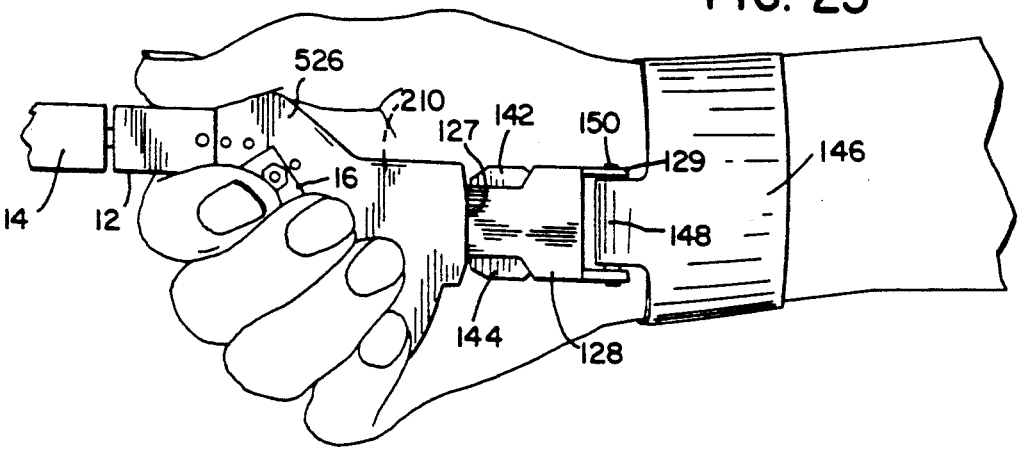
FIG. 24
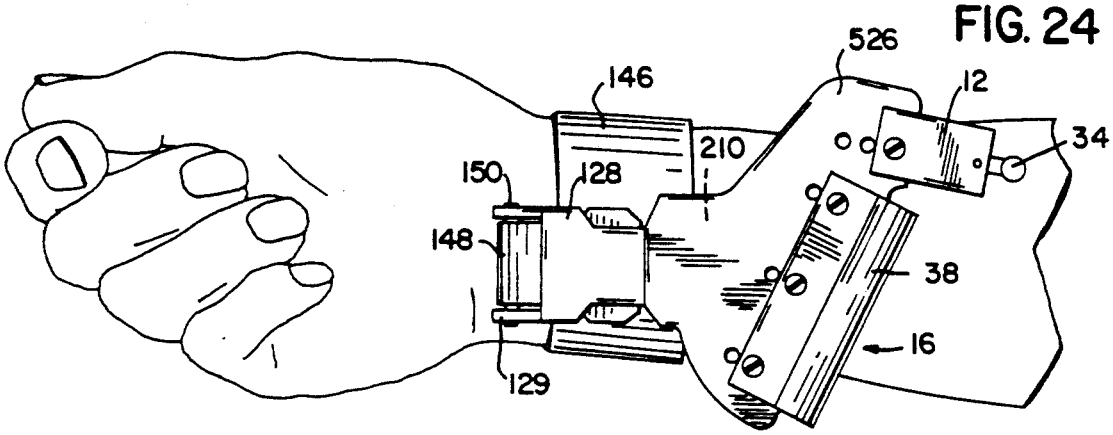
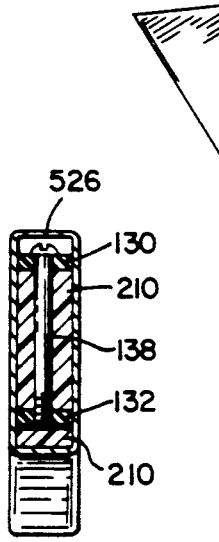
FIG. 25
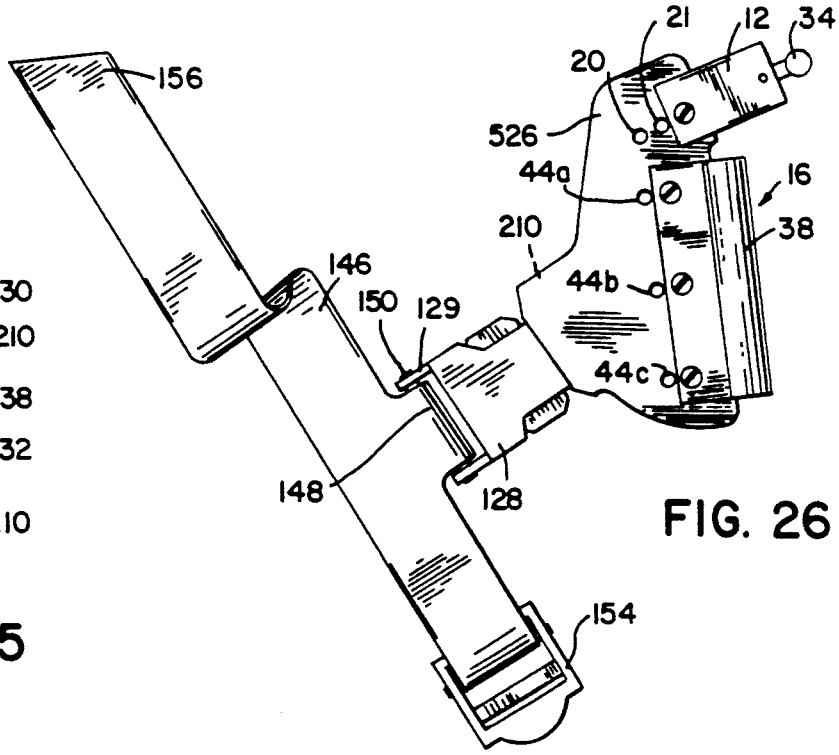
FIG. 26

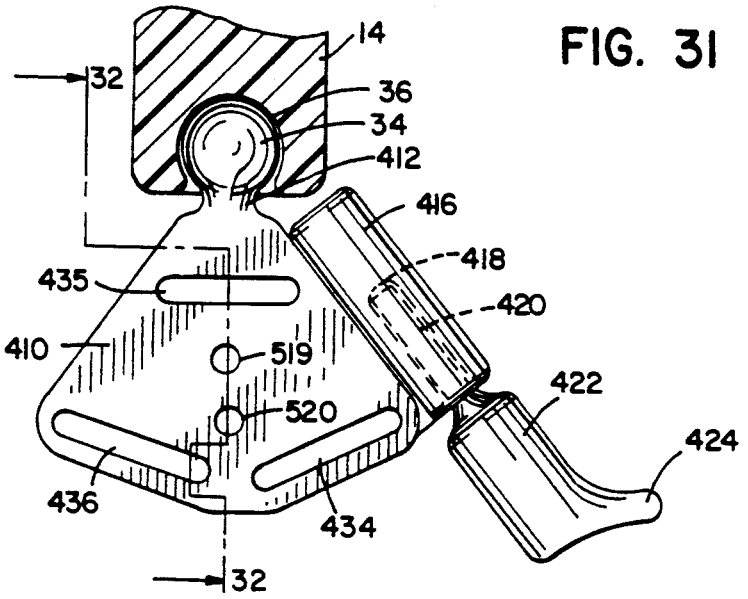
FIG. 31
FIG. 32
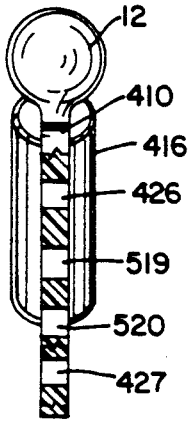
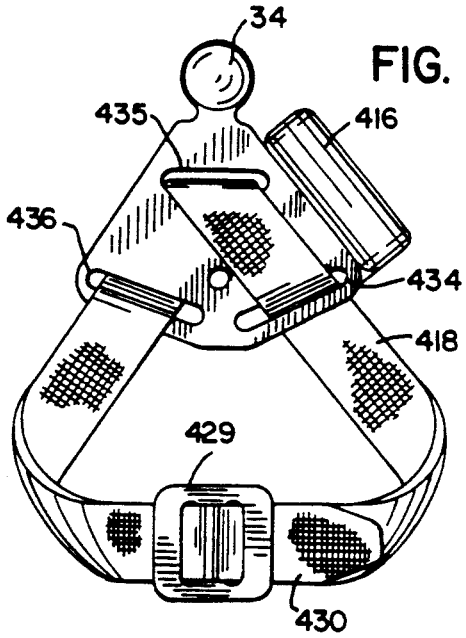
FIG. 33
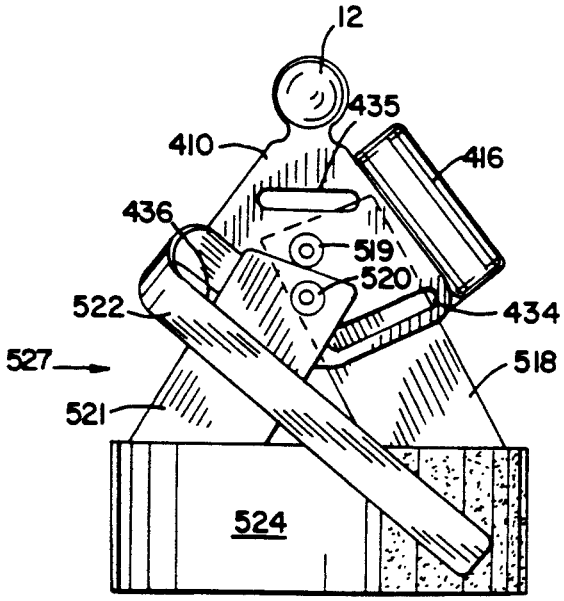
FIG. 34

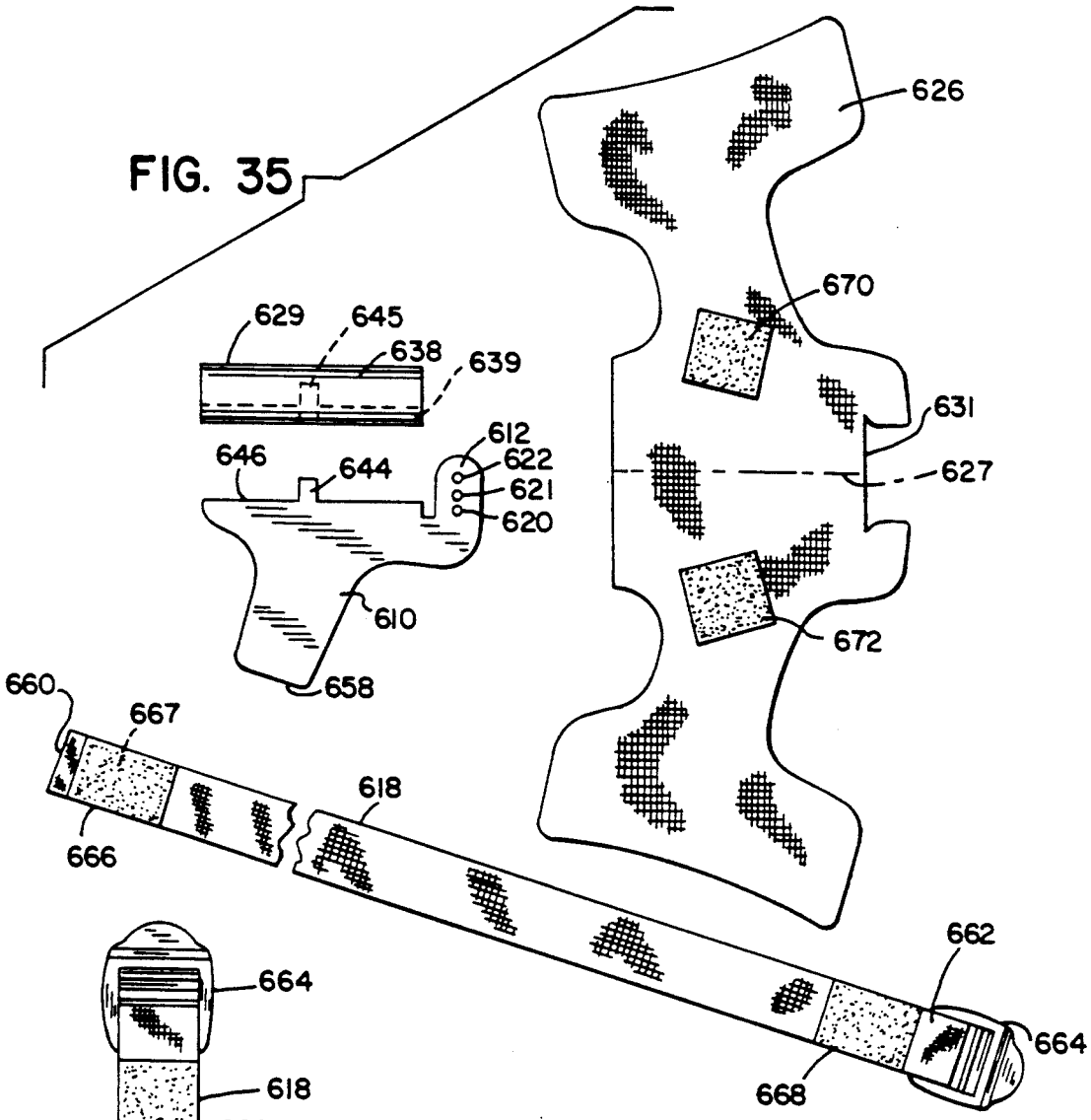
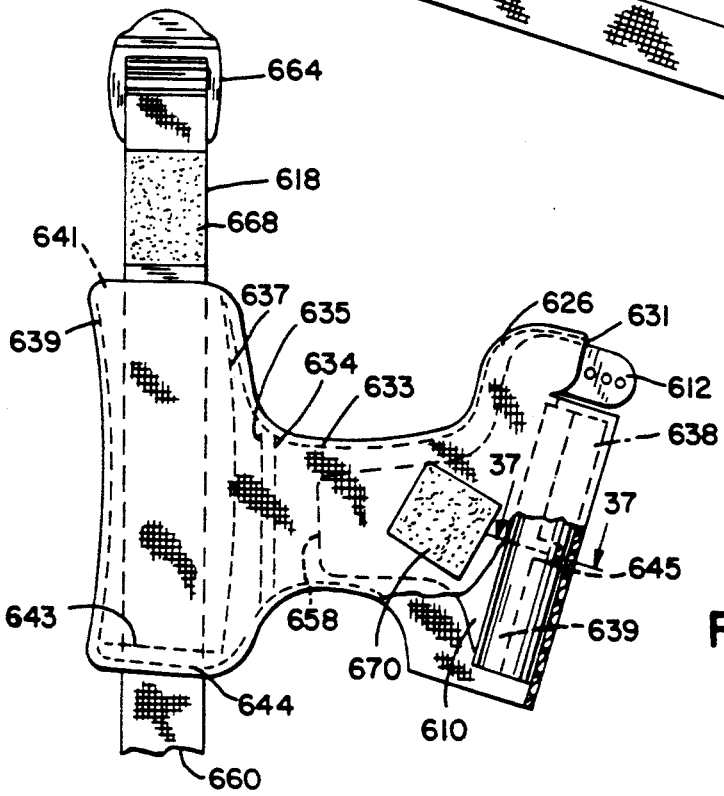
FIG. 36

FIG. 41
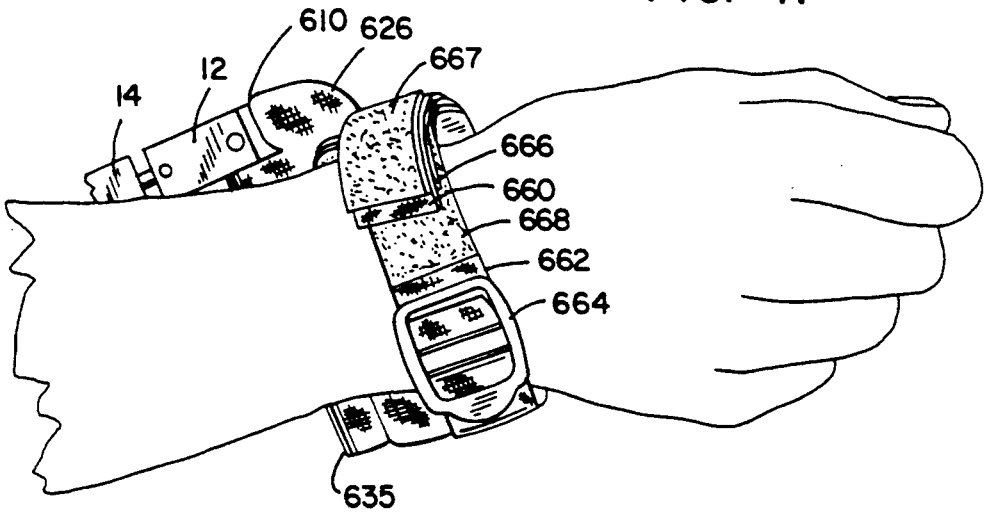
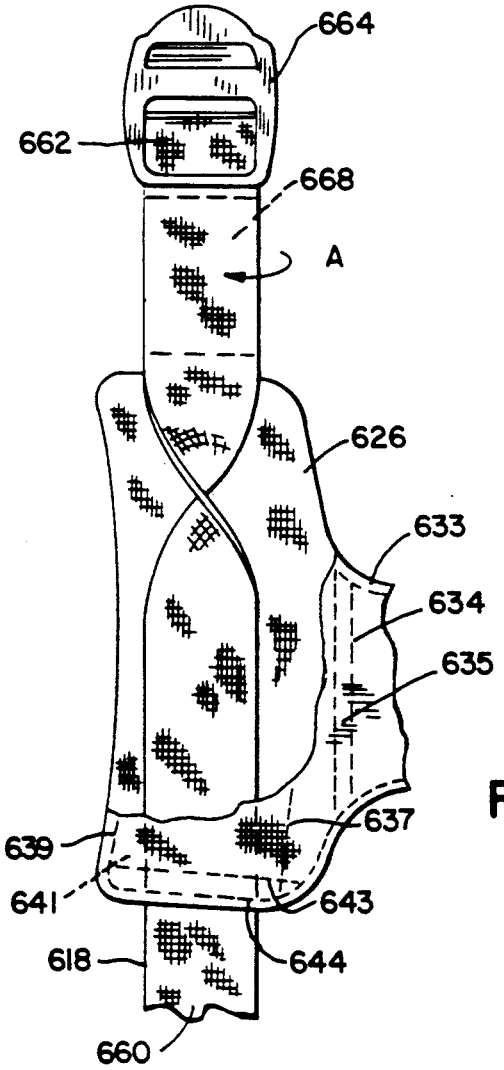
FIG. 42
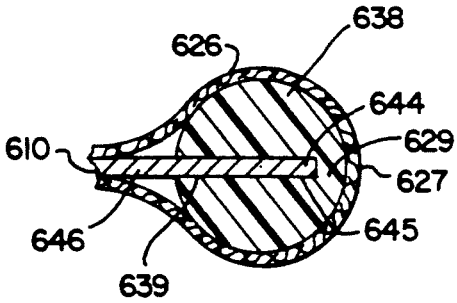
FIG. 37

STRAP ASSEMBLY FOR BOW STRING RELEASE MECHANISM

BACKGROUND OF THE INVENTION

1. Field of the Invention

The invention is related generally to means for securing bow string releases to the hand or wrist of the user and is specifically directed to a wrist strap assembly for detachably securing any of a plurality of bow string release mechanism to the wrist of an archer.

2. Description of the Prior Art

Bow string release mechanisms are well known and have grown in popularity for both target shooting and hunting. A good release provides uniform release of the bow string and increases accuracy. A release should provide for adjustment of the trigger stroke and should allow for adjustment of the relative angular relationship between the handle or grip and the bow string. Typically, it is desirable to secure the bow string release mechanism to the hand or wrist of the user in order to distribute the pull force of the bow over the entire hand and wrist area as the bow is drawn, relieving the tension on the fingers. There are many variations of devices for attaching bow string releases to the wrist or hand of the user, and two typical examples are illustrated in U.S. Pat. Nos. 4,509,497 issued to G. L. Garvison on Apr. 9, 1985, and 3,028,852 issued to R. M. Sutton, Jr. on Apr. 10, 1962.

As shown in both of these patents, the strap assembly includes a means or tab for receiving and securing a bow string release mechanism and a strap which is wrapped around the wrist of the user in the vicinity of the heel of the hand. A second strap or layer of material is contained between the thumb and forefinger of the user for providing additional support. Both strap assemblies cover a large portion of the palm of the hand when the release strap is placed on and secured to the wrist of the user. Garvison, in particular, includes a flexible resilient sheet that covers the majority of the palm of the wearer's hand. This impairs movement and use of the hand for other functions without complete removal of the wrist strap.

In addition, both the Sutton and Garvison wrist straps are designed to fit only a left-handed user or a right-handed user. Also, each is designed to receive only a single, specific bow string release mechanism.

While the prior art wrist strap assemblies for securing bow string releases to the hand of a user have greatly enhanced the functionality of the releases, the difficulty in securing the release to one's wrist coupled with the loss of the use of the hand for any other function while the release is attached has diminished the acceptance and usability of such straps.

SUMMARY OF THE INVENTION

The subject invention is directed to a wrist strap assembly for securing a bow string release to the wrist of an archer wherein the wrist strap is easily attached to and removed from the wrist, distributes the forces generated by the bow string over the entire hand and wrist area, is readily adapted to accommodate both a right-handed and left-handed user and frees the hand of the archer for other functions without removing the wrist strap from the wrist. The wrist strap includes a base member made of a substantially rigid material, to which the straps, bow string release coupler and finger pads are attached. A universal coupler is incorporated in the design, permitting the archer to use the strap assembly with any of a variety of bow string release mechanisms. The coupler is adjustable to accommodate different size string releases and to permit the archer to adjust the position of the trigger relative to his finger and hand to meet his individual taste.

The wrist strap assembly of the present invention includes a finger pad attached to the base which assists in distributing the forces of the bow string over the entire hand and wrist area. It is a feature of the invention that the finger pad may be adjusted relative to the base in order to adjust the position of the pad to the individual comfort and taste of the user.

The base, including the attached finger pad and bow string release coupler may be pivoted back from the hand and out of the way, without removing the wrist strap from the user, permitting the user to perform other functions with his hand while wearing the wrist strap assembly. This is particularly advantageous to an archer since the use of two hands is often required for adjusting the bow, removing arrows from a target and other functions typically related to archery activity. It is very time consuming and cumbersome for the archer to remove the wrist strap from his hand whenever certain of these functions have to be performed.

The invention includes an embodiment having an optional thumb strap for securing the base to the archer's hand between the thumb and forefinger. The thumb strap is included to accommodate archer who desire a tighter, more secure fit between the release mechanism support and their hand. The wrist strap may be designed to permit the fold back feature, removing the wrist strap assembly from interference with the hand by simply detaching the thumb and forefinger strap while leaving the wrist strap in place, and leaving the wrist strap assembly attached to the wrist of the user.

While various configurations of the wrist strap assembly of the present invention are disclosed herein, all include common features permitting the wrist strap assembly to accommodate a plurality of bow string release through use of a universal coupler system, and to be comfortable and efficiently used with varying size hands with adjustability to meet individual requirements of users. Also, all include a rigid base plate to which the finger pad, bow string release coupler and wrist strap members are secured, providing for a rigid, durable assembly. The base plate accommodates both left-handed and right-handed users wherein little or no adjustment or placement of the straps is required when switching from a right-handed device to a left-handed device. All are designed to permit the wrist strap assembly to be pivoted back away from and out of the way of the palm of the hand, permitting use of the hand for other functions without removing the release strap assembly from the wrist of the user. Where desired, the second strap which may be secured between the thumb and forefinger of the user permits a more rigid and tight attachment of the release strap assembly to the hand as well as the wrist, to accommodate the needs and desires of individual users.

In summary, the wrist strap assembly of the subject invention provides a versatile, universal strap and assembly system for securing any of a variety of bow string release mechanisms to the wrist and hand of a user, while permitting the release mechanism to be used by both left-handed and right-handed archers. The strap assembly may be moved to a non-interfering position with the palm of the hand without removing the wrist strap assembly from the wrist of the wearer.

It is, therefore, an object and feature of the subject invention to provide a wrist strap assembly which is adapted for securing any of a plurality of bow string release mechanism to the wrist of a user.

It is another object and feature of the subject invention to provide a wrist strap assembly which accommodates both left-handed and right-handed archers with a minimum of modification.

It is another object and feature of the subject invention to provide a wrist strap assembly which permits the bow string release mechanism to be pivoted out of the way of and in non-interfering relationship with the palm of the archer's hand without removal of the assembly from the wrist of the archer, permitting the archer to perform other functions.

It is another object and feature of the subject invention to provide a wrist strap assembly having a rigid, durable base to which the bow string release mechanism and wrist attachment members are secured, providing for a durable, non-flexible, rigid assembly.

It is another object and feature of the invention to provide a wrist strap assembly which accommodates any of a variety of bow string releases and is adjustable to accommodate varying sized hands and to meet the varying comfort needs of individual users.

Other objects and features of the invention will be readily apparent from the accompanying drawings and description of the preferred embodiments.

BRIEF DESCRIPTION OF THE DRAWINGS

FIG. 4 is a view similar to FIG. 3, showing the wrist strap in the folded back position.

FIG. 5 is a section view taken generally along line 5—5 of FIG. 1.

FIG. 6 is a section view taken generally along the line 6—6 of FIG. 1.

FIG. 7 is a view similar to FIG. 1, showing an alternate embodiment of the wrist strap.

FIG. 8 is a fragmentary view similar to FIG. 7, showing a modification of the wrist strap.

FIG. 9 is a view similar to FIG. 1, showing an alternate embodiment of the wrist strap.

FIG. 10 is a view similar to FIG. 2, with the wrist strap of FIG. 9.

FIG. 11 is a view similar to FIG. 3, with the wrist strap of FIG. 9.

FIG. 12 is a view similar to FIG. 1, showing an alternate embodiment of the wrist strap.

FIG. 13 is a view similar to FIG. 2, with the wrist strap of FIG. 12.

FIG. 14 is a view similar to FIG. 3, with the wrist strap of FIG. 12.

FIG. 15 is a view similar to FIG. 1, showing an alternate embodiment of the wrist strap.

FIG. 16 is a view similar to FIG. 2, with the wrist strap of FIG. 15.

FIG. 17 is a view similar to FIG. 3, with the wrist strap of FIG. 15.

FIG. 18 is a view similar to FIG. 1, showing an alternate embodiment of the wrist strap.

FIG. 19 is a view similar to FIG. 2, with the wrist strap of FIG. 18.

FIG. 20 is a view similar to FIG. 3, with the wrist strap of FIG. 18.

FIG. 21 is a view similar to FIG. 1, showing an alternate embodiment of the wrist strap.

FIG. 22 is a view similar to FIG. 2, with the wrist strap of FIG. 21.

FIG. 23 is a view similar to FIG. 3, with the wrist strap of FIG. 21.

FIG. 24 is a view similar to FIG. 4, with the wrist strap of FIG. 21 in a folded back position.

FIG. 25 is a section view taken generally along line 25—25 of FIG. 21.

FIG. 26 is a view similar to FIG. 21, showing a modification of the wrist strap.

FIG. 31 is a view similar to FIG. 1, showing an alternate embodiment of the wrist strap assembly.

FIG. 32 is a section view taken generally along the line 32—32 of FIG. 31.

FIG. 33 is a view similar to FIG. 31, showing a first strap attachment means secured to the base of FIG. 31.

FIG. 34 is a view similar to FIG. 33, showing a second wrist attachment means secured to the base of FIG. 31.

FIG. 35 is an exploded plan view showing the components of an alternative embodiment of the wrist strap assembly.

FIG. 36 is a plan view of the assembled wrist strap assembly, shown in FIG. 35.

FIG. 37 is a partial section view taken along line 37 of FIG. 36.

FIG. 41 is a reverse view of FIG. 40.

FIG. 42 is a partial plan view similar to FIG. 36, showing reversal of the buckle strap.

DESCRIPTION OF THE PREFERRED EMBODIMENT

Figure 2:
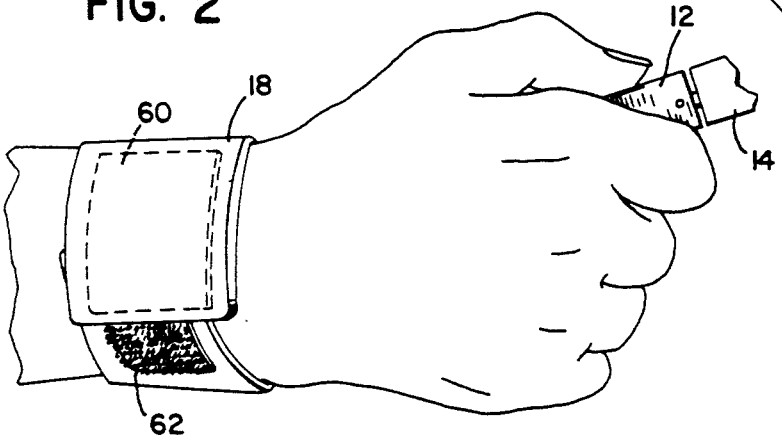
FIG. 2 is a perspective view showing the back of a wearer's hand using the wrist strap of FIG. 1.
Figure 3:
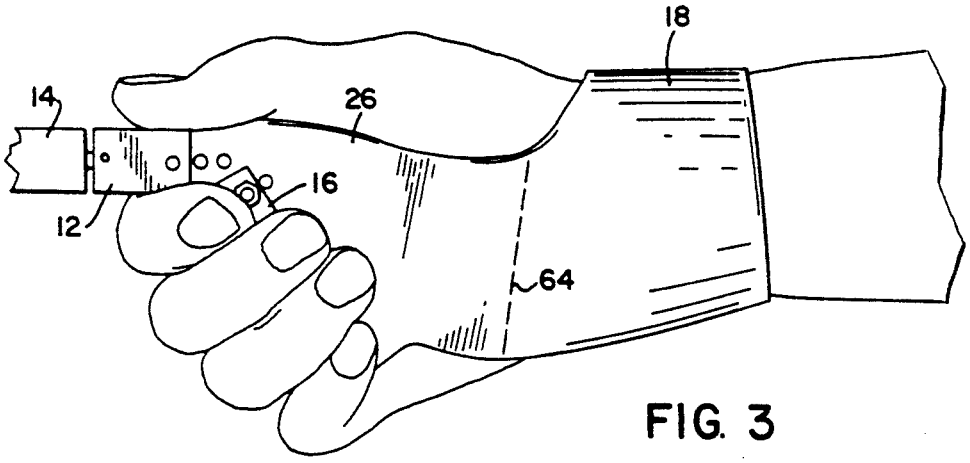
FIG. 3 is a perspective view showing the palm of a wearer's hand, using the wrist strap of FIG. 1.

The wrist straps of the subject invention each include a rigid base 10 or the equivalent for securing any of a plurality of bow string releases 14 through use of a universal coupler 12. The rigid base 10 also includes an enlarged finger pad 16 providing support for the fingers of the user when the wrist strap is worn for use as shown in FIGS. 2 and 3. All of the wrist straps include a strap member 18 or the equivalent, by which the wrist strap is secured to the user's wrist.

A first embodiment of the wrist strap is shown in FIGS. 1–6. A second embodiment, similar to that shown in FIGS. 1–6 but including an alternate strap attachment means is shown in FIG. 7. A universally adaptable modification is shown in FIG. 8.

Figure 1:
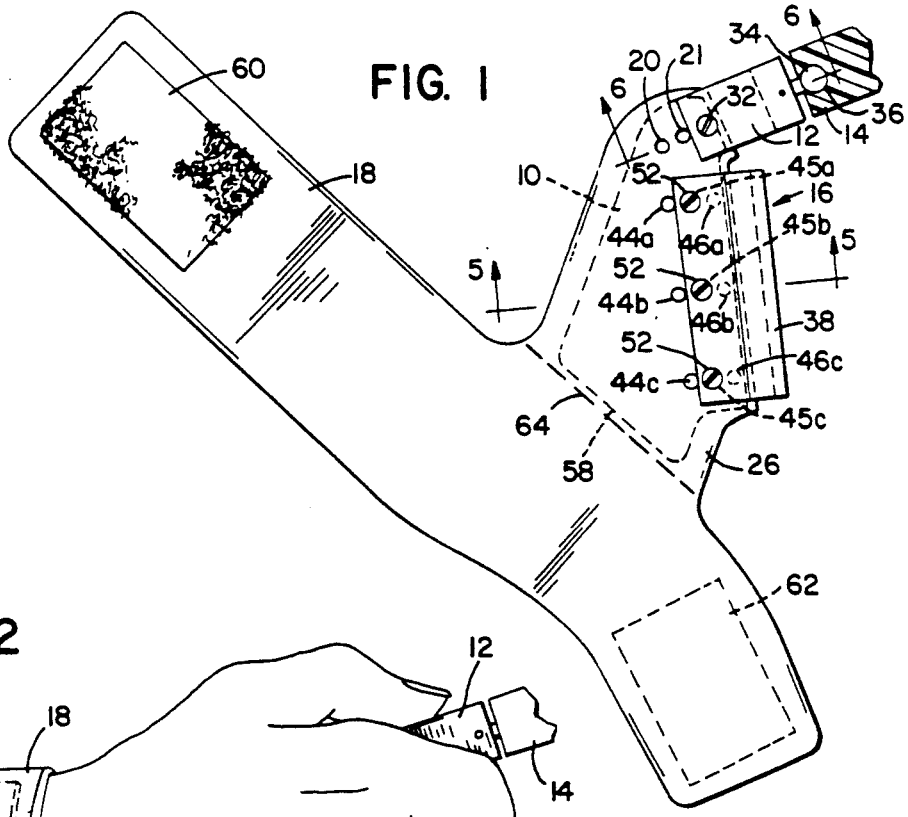
FIG. 1 is a plan view of a bow release wrist strap in accordance with the subject invention.

A third embodiment of the wrist strap, including a base similar to that shown in FIG. 1 but including a second attachment strap is shown in FIGS. 9–11. An alternative of the embodiment of FIGS. 9–11 is shown in FIGS. 12–14. An alternative of the embodiment of FIGS. 9–11 is shown in FIGS. 15–17.

Another embodiment of the wrist strap is shown in FIGS. 18–20. In the embodiment of FIGS. 18–20, the base has been modified to free the palm of the hand at all times, with the main support being placed on the back of the hand.

Figure 27:
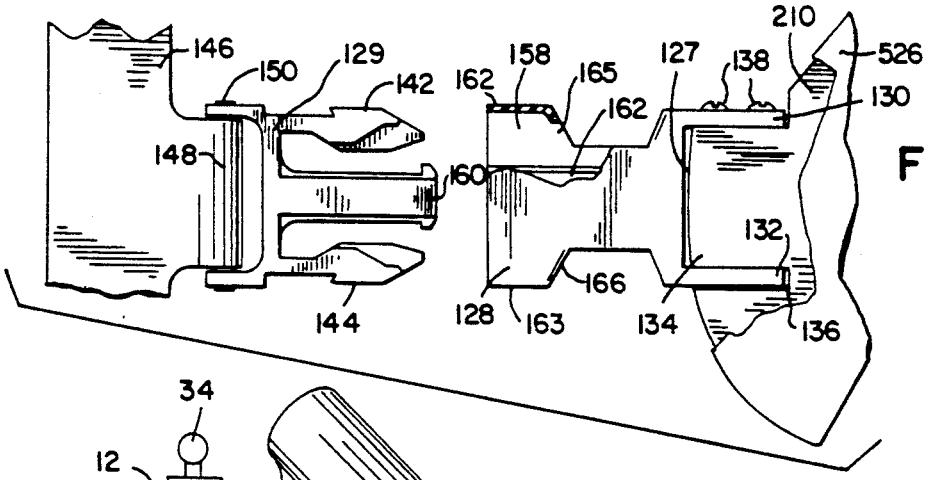
FIG. 27 is an enlarged, fragmentary view showing the wrist strap of FIG. 26 as separated.

Another embodiment of the wrist strap is shown in FIGS. 21–24, wherein the wrist strap attachment means is detachable from the rigid head. A modification of this strap is shown in FIGS. 26 and 27.

Figure 28:
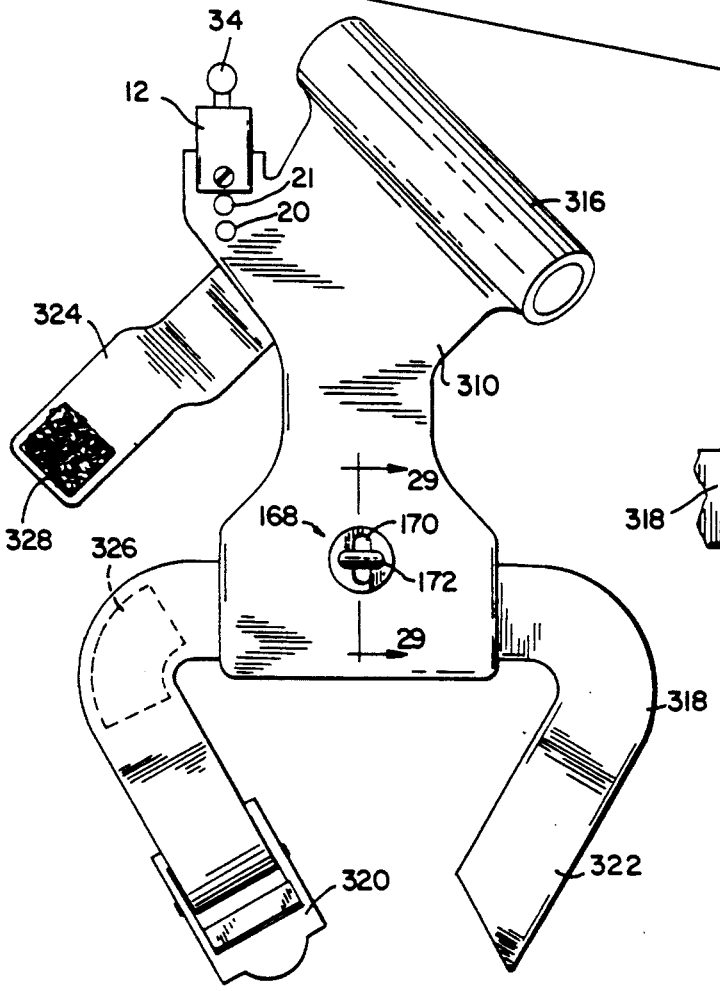
FIG. 28 is a view similar to FIG. 21, showing a modification of the wrist strap.
Figure 29:
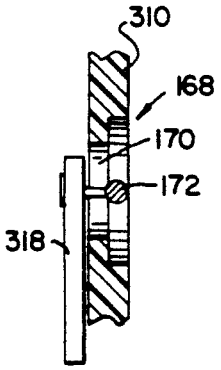
FIG. 29 is a section view taken generally along the line 29-29 of FIG. 28.
Figure 38:
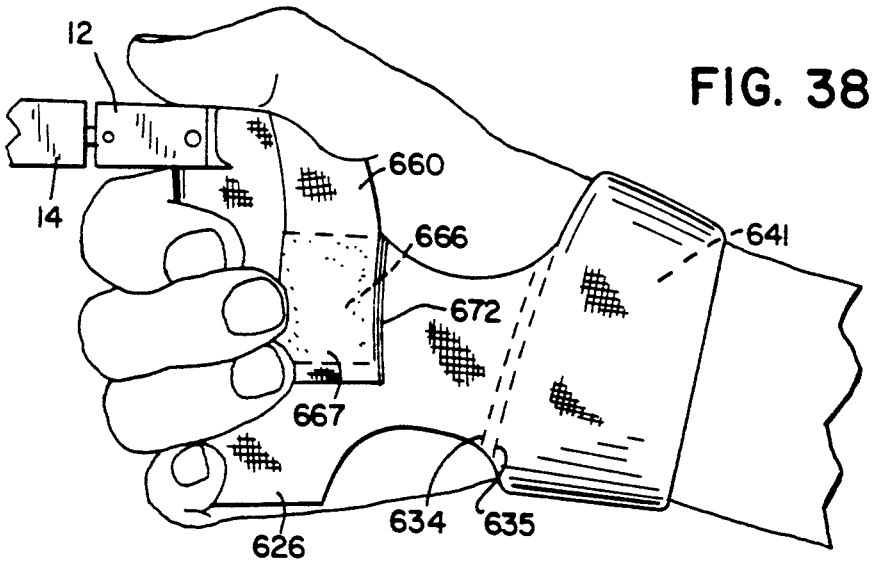
FIG. 38 is a view showing the wrist strap of FIG. 35 as worn by a user.

Another alternate embodiment of this wrist strap, similar to that of FIGS. 21–24, is shown in FIGS. 28 and 29.

Figure 30:
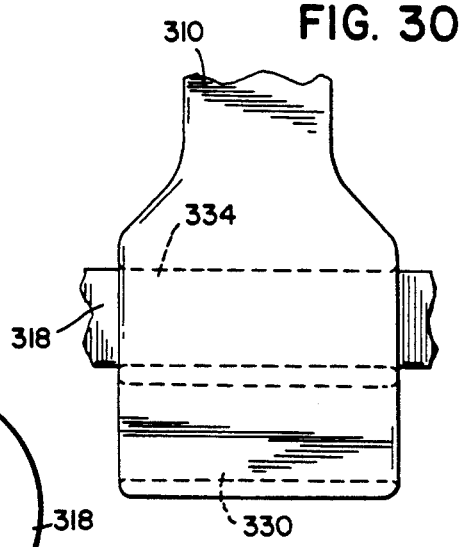
FIG. 30 is a plan view showing an alternate embodiment of the wrist strap, with adjustable strap location means.

FIG. 30 shows a universal modification which may incorporated in any of the wrist straps, providing for adjustability of the wrist strap attachment means.

FIGS. 31–34 illustrate another embodiment of the wrist strap, incorporating a rigid base having an integral coupler and finger pad.

All of the embodiments of the wrist strap have certain common features which are important aspects of the subject invention. In each embodiment, the wrist strap includes a rigid base 10 or the equivalent to which a universal coupler 12 is attached for supporting any of a variety of string releases 14. All of the wrist straps also include a finger pad 16 or the equivalent which is part of or secured to the rigid base 10. All of the wrist straps also include a strap attachment means 18 or the equivalent for securing the release about the wrist of the user, as shown in FIG. 2, behind the hand of the wearer. Also, as is specifically shown in FIG. 4, it is a generally applied feature of the invention that the base 10 can be folded back from the hand, freeing the hand for other operations without removing the release from the wrist. Other generally common features include means for adjusting the position of the universal coupler 12 relative to the base 10 and for adjusting the finger pad 16 relative to the base 10. This permits a single size wrist strap to be used to accommodate varying sizes of hands of a variety of users. It is also an important aspect of the invention that the assembly of each embodiment can be used by either a left-handed or a right-handed archer with little or no modification.

With specific reference to the embodiment of FIGS. 1–6, the base 10 is generally a rigid material such as hard plastic or steel and includes a plurality of mounting holes 20, 21 and 22 (see FIG. 6) to which a universal coupling 12 may be attached for receiving the string release 14. As shown in FIG. 6, the universal coupling 12 comprises a U-shaped bracket having a center slot 24 which is adapted for receiving the rigid base 10. Where desired, the rigid base 10 may be wrapped in a soft, flexible material 26 such as leather or vinyl for both comfort and aesthetics. In the preferred embodiment, the universal coupling 12 includes a through hole 28 on one side of the U bracket and a tapped hole 30 diametrically opposite thereof. A threaded screw 32 is adapted to be received in one of the holes 20, 21 and 22 for securing the coupling 12 to the base 10. The universal coupling permits pivotal movement of the release 14 relative to the base 10 about the pivot point defined by the screw 32. In the preferred embodiment, the universal coupling includes a ball coupler 34 for receiving the socket 36 of a typical release. However, it will be readily understood that other types of coupler mechanisms can be readily employed without departing from the scope and features of the subject invention.

As is best shown in FIGS. 1 and 5, the finger pad 16 comprises an elongate rolled bracket having an enlarged rounded pad surface 38 and a pair of mounting plates 40 and 42. The plates 40, 42 are adapted to be spaced apart for receiving the rigid base 10 and, where used, the cushioning cover 26. The base 10 includes a plurality of through holes 44*a*, 44*b*, 44*c*, 45*a*, 45*b*, 45*c* and 46*a*, 46*b*, 46*c*. The plates 40, 42 include a plurality of complementary through holes 48 and 50 which may be aligned with holes 44*a*–44*c*, or 45*a*–45*c*, or 46*a*–46*c* for positioning the finger pad relative to the base 10. In the preferred embodiment, threaded screws 52 is passed through a set of complementary holes 48, 50 and 45*a*–45*c* (as shown in FIG. 5). Nuts 54 are secured to the screw for holding the finger pad 16 on the base 10. The finger pad 16 may be made of any of a variety of materials and may comprise a rigid molded plastic member or a soft, pliable leather or vinyl member, as desired. When a soft, pliable finger pad is utilized, a semi-rigid cushion 56 may be inserted inside the rounded pad portion 38 to provide additional resiliency and comfort.

In the embodiment of FIG. 1, the pliable cushioning material 26 is extended beyond the outer rear edge 58 of the base 10 and is formed into an integral wrist strap 18. The wrist strap 18 is used to attach the release strap assembly to the wrist of the user behind the hand, as shown in FIGS. 2–4. In the embodiment of FIG. 1, the wrist strap includes a first hook and loop-type fastener pad 60 and a mated hook and loop-type fastener pad 62 on opposite sides of the outer ends of the strap, whereby the strap may be readily secured to the wrist as shown in FIG. 2.

It is an important feature of the subject invention that the strap assembly may be folded back from the palm and fingers of the wearer without removing the assembly from the wrist, as shown in FIG. 4. The cushioned padding and strap material 26 defines a live hinge at 64, whereby the base 10 of the strap assembly may be folded back. Where desired, the live hinge 64 may be stitched or scored as shown in FIGS. 1–4 to facilitate the hinging action of the material 26. A perforated version of the live hinge 64 is shown in FIG. 8, wherein the perforations 65 replace the stitching or score lines shown in FIGS. 1–4.

In use, the release strap assembly of FIG. 1 is secured to the wrist as shown in FIGS. 2 and 3, wherein the rigid base 10 is carried by the palm of the hand and the finger pad 16 is positioned to easily accommodate at least three fingers of the wearer. The release coupler 12 extends outwardly between the thumb and forefinger for holding the string release 14 in the well known manner for attaching the string release to a bow string. When the hand is needed for functions not requiring the use of the bow release and release strap assembly, the release may be folded back along the live hinge 64, as shown in FIG. 4, freeing the hand for other functions.

An alternative embodiment of the release strap assembly of FIG. 1 is shown in FIG. 7. As there shown, the rigid base 10, the coupler 12, finger pad 16 and the cushioning material 26 which defines the strap 18 are substantially identical to that shown in FIGS. 1–6. The hook and loop-type fastener pad 60, 62 have been deleted and replaced with a strap buckle assembly 68 which includes a strap member 70 and a buckle assembly 72 secured to the opposite end of the strap 18. In use, the strap 70 is passed through the buckle 74 in the well known manner for securing the strap assembly to the wrist of the user. The wrist strap is worn by the user in the same manner as is generally shown in FIGS. 2–4.

An alternative embodiment of the strap assembly is shown in FIGS. 9–11. As there shown, the base 10, universal coupler 12 and finger pad 16 are substantially identical to that shown in FIGS. 1–8. The resilient cushioning material 126 which is used to wrap the base 10 is redesigned to provide for a pair of attachment straps 76 and 78. The strap 76 projects upwardly and outwardly from the base 10 and is disposed adjacent to the universal coupling 12. The strap 78 is disposed behind the live hinge 64 and extends outwardly from the base in generally the same direction as the strap 76. A first hook and loop-type fastener pad 80 is secured at the outer end of the strap 76. A complementary hook and loop-type pad 82 is disposed on the outer end of the bottom side (as shown) of the strap 78. Strap 78 includes a hook and loop-type fastener pad 84 on the top side thereof and a complementary hook and loop-type pad 86 on the opposite end and on the bottom side adjacent the live hinge 64.

The release strap assembly of FIGS. 9–11 is adapted to be secured to the wrist as shown in FIGS. 10 and 11, with the rigid base 10 as covered by material 126 being held in the palm of the hand in much the same manner as the embodiment of FIGS. 1–6. The wrist strap attachment means 78 is wrapped around the wrist, behind the hand as shown in FIG. 10, with the Velcro pad 84 being attached to the complementary pad 86, in the same manner as is also generally shown in FIGS. 1–6. The second strap 76 is positioned between the thumb and forefinger and wrapped around behind the hand as shown in FIG. 10, and back around the front of the hand in the area adjacent the wrist (FIG. 11). The fastener 80 is secured to either the complementary pad 82 provided on the back side of the strap 78 or directly to pad 86 for securing the release assembly, as shown in FIGS. 10 and 11.

As in the embodiments of FIGS. 1–8, the release assembly of FIGS. 9–11 can be folded back from the palm along the live hinge 64. In order to accomplish this, the strap 76 is detached from the fastener pad 82 or 86, releasing the strap from the area between the thumb and forefinger and permitting folding back of the release assembly to free the hand for other functions. After the strap base is folded back over the wrist and away from the palm, strap 76 can be placed over it and secured to pad 82, to hold the base in the stowed position.

An embodiment similar to that shown in FIGS. 9–11 is shown in FIGS. 12–14. When an archer does not desire to have the fold back feature of the embodiments of FIGS. 1–11, the dual strap arrangement shown in FIGS. 9–11 can be replaced with the single strap 88 defined by the modified cushion material 226. In this embodiment, the single strap 88 is wrapped first between the thumb and forefinger and around the back of the hand, as shown in FIG. 13, then across the heel of the hand adjacent the wrist, shown in FIGS. 14, then back around the wrist, and secured to the base of the release. A first fastener pad 90 is provided adjacent the release base on the underside (as shown in FIG. 12), a second fastener pad 92 is provided rearwardly of the first pad 90 and on the same side of the release assembly. The strap includes a plurality of fastener pads 94 and 96. The first fastener pad 94 is disposed intermediately of the opposite ends of the strap 88 and is secured to the pad 90, as shown in FIG. 14. The second pad 96 at the outer end of the strap 88 is secured to the pad 92 for securing the release assembly to the wrist.

Of course, it will be readily understood that the specific placement of the pads and the number of pads is a matter of choice. For example, the outer end of the strap 88 may be secured directly to the strap 88 on a pad 98 provided on the opposite side of the strap in the vicinity of the pad 94, as shown in phantom in FIGS. 12 and 14.

An alternate embodiment of the strap assembly, similar to that shown in FIGS. 9–12, is shown in FIGS. 15–17. As there shown, the cushion surface 326 is modified to provide straps 100 and 102 which are projecting outwardly away from each other as they project from the base 10 of the release assembly. As shown in FIG. 16, the strap 102 is secured about the wrist as in the embodiments of FIGS. 1-11. The strap 100 is disposed between the thumb and forefinger and about the back of the hand and back to the front of the hand near the heel, as shown in FIG. 17. In the preferred embodiment, a hook and loop-type fastener pad 104 is provided at the outer end of strap 100 and a hook and loop-type fastener pad 106 is provided at the outer end of strap 102. A complementary fastener pad 108 is provided adjacent the base 10 on the opposite side of the release assembly for securing the release assembly to the wrist. In order to fold back the strap assembly of FIGS. 15–17, the strap 100 is detached and the release assembly may be folded back from the hand of the user at the live hinge 64, as in the previously described embodiments.

Another embodiment of the strap assembly is shown in FIGS. 18–20. As there shown, a modified rigid base 110 is slightly reduced in size so that it does not overlie the palm of the hand (see FIG. 20). The cushion surface 426 is designed so that the major support portion of the surface defines a resilient pad 112 which is adapted for overlying the back of the hand between the knuckles and the wrist, as shown in FIG. 19. The live hinge for permitting folding back of the release is provided at 164 behind the pad portion 112. The cushioned material 426 terminates in an elongated wrist strap 114 disposed outwardly of the live hinge 164. As in previous embodiments, the wrist strap 114 includes a pair of hook and loop-type fastener pads 116 and 118 at its opposite ends, whereby the wrist strap 114 is secured about the wrist as shown in FIGS. 19, 20 for securing the release assembly to the wrist of the user.

A second strap 120 is disposed adjacent the base 110 between the finger pad 16 and the universal coupling 12. The strap 120 includes a fastener patch 122 at its outer end. The strap 120 is adapted to be placed between the thumb and forefinger and attached to the fastener patch 124 provided on the underside of the strap assembly, or on the back of the hand as shown at FIG. 19. When it is desired to fold back the release assembly of FIGS. 18–20, the strap 120 is detached from the pad 112 and the release coupling 12 and base 110 may drop down below the hand, after which the pad 112 can be folded back along hinge 164 between the pad 112 and the strap 114 to free the hand for other functions. As in other embodiments, the strap 120 can be used to secure the assembly in the stowed position after the base has been placed in the folded back position.

Another embodiment of the strap assembly is shown in FIGS. 21–25. As there shown, the base 210 is similar in construction to the bases 10, 110 of the previously described embodiments and include means for supporting the universal coupling 12 and the finger pad 16. The rigid base 210 may be wrapped with a resilient cushioning material 526, as desired. The side edge 127 opposite the finger pad 16 is adapted for receiving a fastener component 128, as shown in FIG. 21.

As best shown in FIG. 27, the fastener comprises the female receptacle 128 and the male latch 129. The fastener system is a lateral detent-type fastener wherein the receptacle 128 comprises a yoke having a U-shaped base comprising legs 130, 132. The base 210 includes a flat mounting surface 134 and an elongate slot 136 for receiving the U-shaped yoke of the fastener element 128. As shown in FIG. 25, the fastener element 128 may be secured in the base 210 by fastener means such as the threaded screws 138 which are received in suitable holes provided in the yoke legs 130, 132 and through holes provided in the base 210. The male latch element 129 of the fastener system includes a pair of detent tabs 142, 144 for securing the element 129 and the wrist strap 146 attached thereto in the receptacle component 128 of the fastener, as shown in FIG. 21. The receptacle 128 includes an enlarged cavity 158 (FIG. 27) having an open outer end adapted for receiving the three pronged male latch component 129, wherein the center prong 160 forms a guide rail which is adapted to be received in the complementary slot 162 provided in the receptacle 126. The two outer prongs 142 and 144 are resilient to define the detents and are compressed by the side walls 162, 163 of the chamber 158 as the latch 129 is inserted axially into the receptacle 128. Slots 165, 166 are provided in the side wall of the receptacle through which the resilient detents 142, 144 project once the latch 129 is fully inserted in the receptacle 128. In order to withdraw the fastener latch 129 from the receptacle 126, the detents 142, 144 are depressed into slots 165, 166, permitting axial withdrawal of the latch 129. This permits the release base 210 and the components associated with it to be separate from the wrist strap without removing the wrist strap from the wrist of the wearer.

The wrist strap 146 comprises an elongate strap having an extension loop 148 which is wrapped to envelope and engage the pin 150 on the outer legs of the fastener latch component 119 for pivotably mounting the strap 146 on the strap assembly. As in prior embodiments, the opposite ends of the strap 146 include fastener pads 151 and 152, whereby the strap assembly can be secured to the wrist as shown in FIGS. 22, 23. When it is desired to free the hand for other functions, the strap assembly of FIGS. 21–24 may be rotated to the folded back position by pivoting the fastener system comprising components 128 and 129 and the base 210 of the release about the post 150 to the position of FIG. 24.

The embodiment of FIG. 26 is similar to that shown in FIGS. 21–24, with the strap 146 being modified to include a standard buckle-type fastener comprising the buckle 154 and free end 156 of the strap 146, whereby the strap is secured to the wrist in the manner well known. Once secured to the wrist, the strap assembly of FIG. 26 functions in the same manner as the strap assembly of FIGS. 21–25.

Another embodiment of the wrist strap assembly is shown in FIGS. 28, 29. In this embodiment, the fastener comprises an elongated base 310 having an integral finger pad 316 and means for attaching a universal coupling 12, as in the prior embodiments. The base 310 and integral finger pad 316 may be made of unitary molded construction. A rotational fastener assembly 168 is contained in the base 310 and includes an elongated slot 170 which is adapted for receiving the elongated fastener element, see also FIG. 29. The fastener element 172 is secured to the wrist strap 318 which in the preferred embodiment includes the buckle-type fastener comprising the buckle 320 and the strap end 322. A second strap 324 may be provided and is adapted to be secured to the base 310 adjacent the universal coupling 12. As in prior embodiments (see FIG. 16), the strap 324 is adapted to be wrapped between the thumb and forefinger and over the back of the hand after which it is secured to the fastener patch 326 provided on the underside of strap 318. The strap 324 includes a complementary fastener patch 328 at its outer end for this purpose. The assembly may be folded back once strap 324 is released, without removing strap 318 from the wrist.

As shown in FIG. 30, the base 310 can be modified to include a plurality of parallel slots 330 and 334. The strap 318 may be inserted in either of the slots, permitting the string release strap assembly of FIG. 30 to accommodate different size hands by selecting the appropriate slot for the strap 318. In this embodiment, the rotatable fastener assembly 168 has been deleted.

FIGS. 31–34 show an alternative embodiment of the invention wherein the base 410 is made of a rigid material which includes an integral universal coupling such as the ball and socket coupling 412 and an integral finger pad 416. The base 410 may be made of a unitary molded construction. The finger pad 416 includes an internal central bore 418 for receiving the post 420 of finger pad extender 422. The post is received in a snug fitting relationship in the bore 418 and extends the finger pad 416 to accommodate additional fingers of the hand once the wrist strap assembly is secured to the wrist. A projecting pad 424 may be provided on the outer end of the extension 420 to permit a resting cradle for the small finger of the wearer to further enhance comfort and assist in placement of the release strap assembly in the hand.

As shown in FIG. 32, the base 410 includes a plurality of holes and through slots for receiving the wrist strap attachment of the assembly.

The embodiment of the strap shown in FIG. 33 includes an elongate strap 418 of the type having a standard buckle fastener 429 for receiving and securing the free end 430 of the strap, in the well known manner. The free end 430 of the strap is inserted through slot 434 and then through slot 435 of the base. It is then folded back over and inserted through slot 436 and outward to form the generally triangular shape shown in FIG. 33 when end 430 of the strap is placed through the buckle 429. In order to place the strap assembly 33 on the wrist of the wearer, the base 410 is held in the palm of the hand with the fingers engaging the finger cushion 416. The strap is then wrapped around the back of the wrist with the buckle on the back of the wrist and tightened. As with prior embodiments, the flexible strap operates as a live hinge which permits the base 410 to be folded back on the wrist without requiring removal of the wrist strap assembly from the wrist, freeing the hand for other functions.

An alternative embodiment of strap attachment is shown in FIG. 34. As there shown, a first strap section 518 may be secured to the base 410 by using fasteners in the through hole 519. A second strap section 521 is likewise secured at hole 520. The sections 518 and 521 combine with the third strap section 524 to form the generally triangular wrist strap of FIG. 34. A second strap 522 may be secured to the base 410, also utilizing the fastener hole 520. Strap 522 is adapted to be placed between the forefinger and thumb with the outer end thereof over the back of the hand and secured to the strap section 524. The strap 522 may be either permanently attached to the strap 524 or may be releasably secured by using hook and loop-type fasteners or the like, as previously described. In the preferred embodiment, the straps 518, 521, 522, 524 are made of a semi-rigid material such as stiff leather or the like and are permanently in the position shown in FIG. 34, whereby the release assembly of FIG. 34 is placed on the hand of the user by inserting the hand through the opening between the base 410 and the outer portion 524 of the strap with the thumb being disposed in the space 527 in much the same manner as a glove is placed on the hand.

An important feature of the strap assembly of the subject invention is that the straps are generally usable by both left-handed and right-handed archers with minimum or no alteration. For example, the strap of FIG. 1 is readily usable by either a left-handed or right-handed archer without alteration. This is also true of the strap of FIG. 21. The other straps can generally be used by a left-handed or right-handed person by simply redistributing the hook and loop fastener pads so that they are on the proper side of the strap assembly when placed on the wearer's wrist. No alteration of the base is required in any of the embodiments.

An alternative embodiment of the wrist strap assembly is shown in FIGS. 35–42. As there shown, the base 610 is a flat plate similar in configuration to the base plates of the embodiments of FIGS. 1, 7, 9, 12, 16 and 20. Specifically, the base plate 610 includes an outer projecting tab 612 having a plurality of mounting holes 620, 621 and 622 for receiving the universal coupler such as universal coupler 12 shown in FIG. 1. A mounting post 644 is provided on the flat surface of the plate 610 below the coupler tab 612 (as shown in FIGS. 36–42). The post 644 is adapted to receive and secure the enlarged finger pad 638 which is defined by a split cylinder and includes a post receptive receptacle or socket 645 for receiving the mounting post 644. As best shown in FIG. 37, the cylinder 638 includes an elongate slot 639 which is adapted to be placed over the flat outer edge 646 of the base plate 610 with the mounting post 644 being received in the receptive socket 645 in the cylinder. This holds the cylinder 638 in position on the base plate 610.

The cover material 626 is shown in its unfolded condition with the outer surface up, as drawn, in FIG. 35. The cover 626 is designed to wrap the base plate and enlarged finger pad as particularly shown in FIGS. 36 and 37. The imaginery center line 627 of the cover 626 is placed along the outer edge 629 of the enlarged finger pad and wrapped around both sides of the base plate 610 for defining a covered strap assembly as in prior embodiments. Once wrapped, the universal coupler mounting tab 612 extends through the opening defined by the notch 631 in the cover, as best seen in FIG. 36. The perimeter of the cover 626 may be stitched closed or otherwise suitably secured, as shown at 633 of FIG. 36. A pair of parallel stitch rows 634 and 635 are provided through both sides of the folded cover rearwardly of the outer end 658 of the base plate for defining a live hinge about which the wrist strap assembly may be folded over the wrist and out of the way when the wrist strap is not in use.

A second pair of spaced apart parallel stitch rows 637 and 639 define an open channel 641 through the cover for receiving the fastener strap 618. As best shown in FIG. 35, the fastener strap 618 includes an elongate, non-stretchable flexible strap member having opposite outer ends 660 and 662. A standard loop over friction-type buckle 664 is mounted on one end 662 of the strap and is adapted to receive the flap defined by the outer end 660 of the strap, as will be explained. A pair of hook and loop-type fastener pads 666 and 668 are disposed adjacent the outer ends 660 and 662 of the strap. A like pad 667 is disposed on the underside of the strap in alignment with pad 666. It will also be noted that a pair of hook and loop-type fastener pads 670 and 672 are secured to the outer surface of the assembly cover 626. As will be explained, pads 666 and 672 are used for a right-hand configuration and pads 667 and 670 are used for a left-hand configuration.

As best shown in FIGS. 36 and 42, the strap 618 is inserted through the channel 641. Flap end 660 of the strap is secured in place in the channel by stitching or other means, as shown at 643 and 644. The remainder of the strap in the channel and the buckle end 662 remain free. This permits the strap buckle end 662 to be twisted as shown by arrow A (FIG. 42), permitting the wrist strap assembly to be readily adapted to both left and right-hand use by reversing orientation of the buckle 664.

Figure 39:
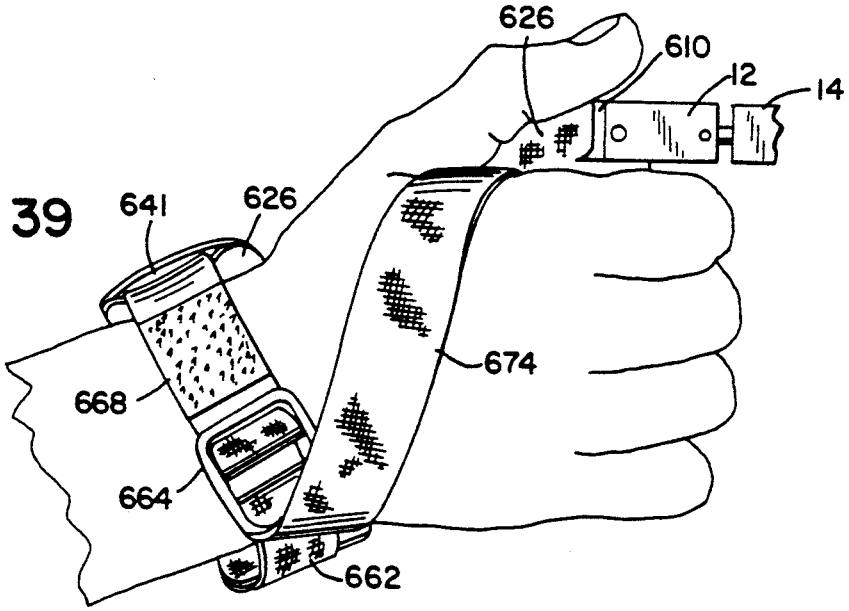
FIG. 39 is a reverse view of FIG. 38.

The strap assembly of the embodiments of FIGS. 35–42 is shown in use in FIGS. 38–41, as oriented for a right-handed wearer. As there shown, the base 610 and enlarged finger support 638, as wrapped by the cover 626 are placed in the palm of the hand. As best shown in FIG. 39, the flap end of the strap, which is at the bottom of the hand, is then placed through the buckle 664 and tightened to the desired tension by the wearer for securing the strap assembly to the wrist. The loose flap end is then placed over the back of the hand as shown at 674 (FIG. 39) and through the thumb and forefinger and back over to the palm of the hand where the hook and loop fastener pad 666 on the underside of the strap is secured to the complementary pad 672 on the palm portion of the cover 626.

For a left-hand configuration, the buckle end 662 of the strap is twisted as shown in FIG. 42, and the release is placed in the left palm, with the flap 660 placed through and tightened in the buckle and up over the back of the hand, between the thumb and forefinger, with the pad 667 on the flap secured to the pad 670 on the cover.

Figure 40:
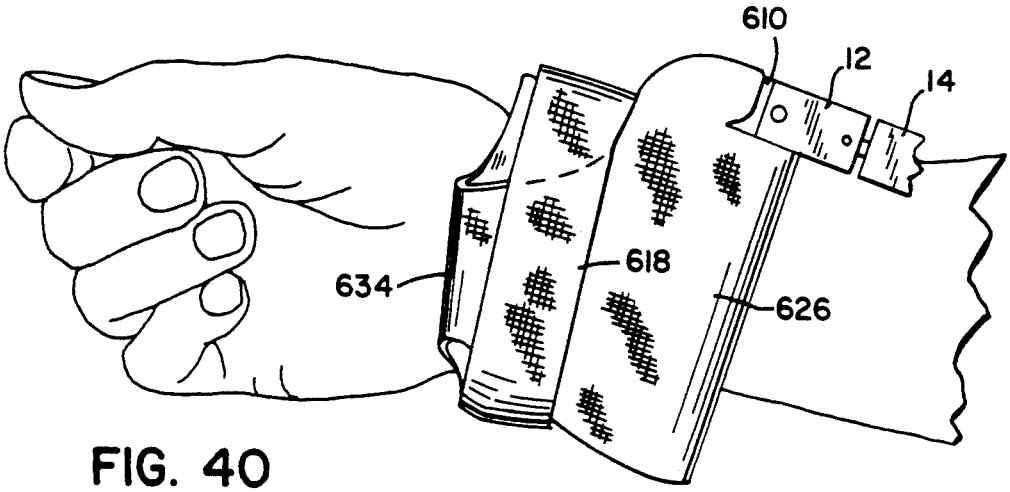
FIG. 40 is a view showing the wrist strap assembly of FIG. 35 in the folded back condition.

As shown in FIG. 40, the strap assembly of the subject invention can be folded back away from the palm of the hand when the release is not in use.

Specifically, the cover portion 626 is folded along the live hinge defined by the stitching rows 634 and 635 to fold the base, enlarged finger pad and universal coupler away from the hand as shown in FIG. 40. In order to accomplish this, the strap 618 is first removed from the pad at the palm of the hand and is pulled back through the thumb and forefinger. The base is then folded back as shown in FIG. 40 and the strap 618 is wrapped under the wrist of the hand and across the front of the wrist as shown and secured via the pad 668 provided on the buckle end 662 of the strap 618. As shown in FIG. 41, this securely holds the strap in place behind the hand freeing the hand for other operations.

Figure 43:
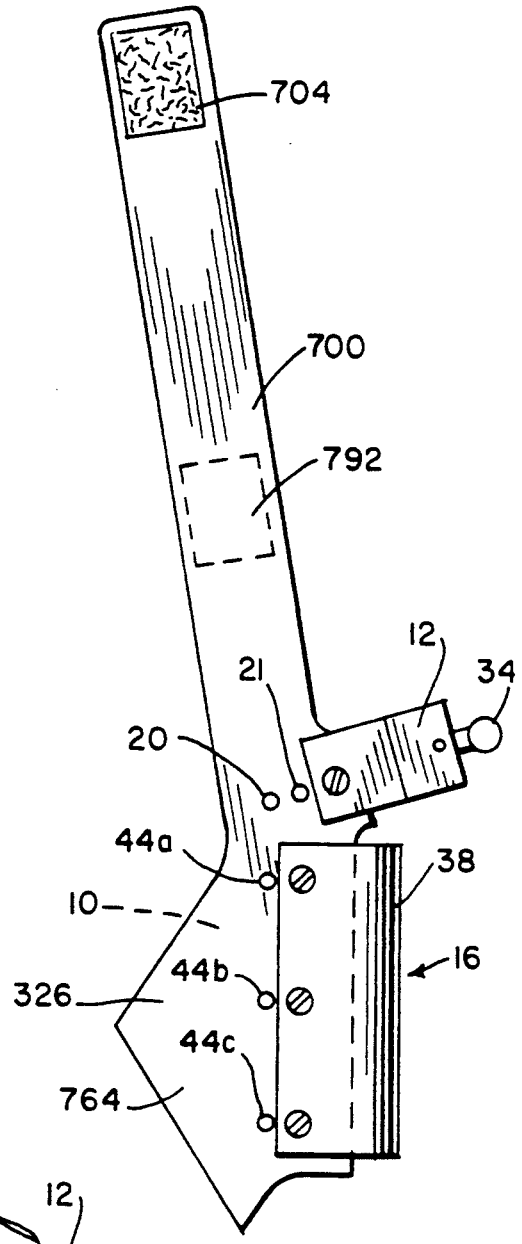
FIG. 43 is a view similar to FIG. 15, showing an alternative embodiment of the wrist strap.
Figure 44:
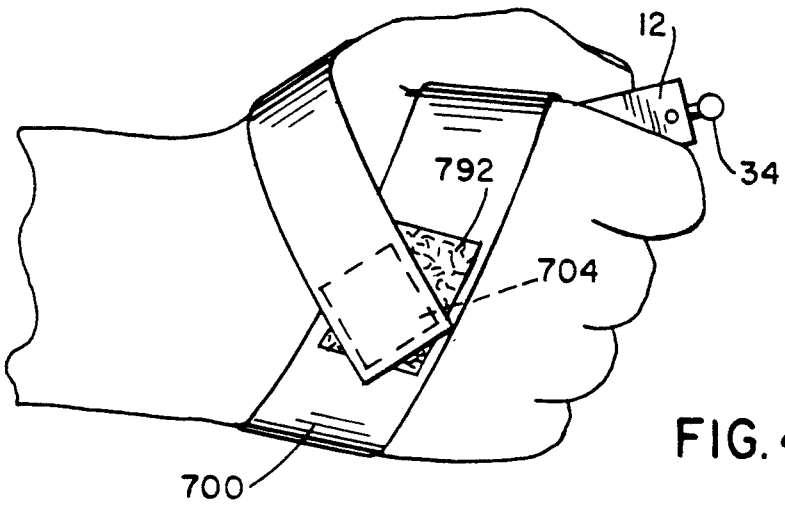
FIG. 44 is a view similar to FIG. 16, with the wrist strap of FIG. 43.

An alternative embodiment of the wrist strap is shown in FIGS. 43 and 44. As thereshown, the wrist strap has the same general configuration as the wrist strap shown in FIGS. 15 and 16, wherein the portion of the strap behind the live hinge 64 (FIG. 15) has been deleted, with the base portion of the strap terminating along the boundary 764. In addition, the elongate strap extending outwardly from the head 12 has been extended, as shown at strap 700 of FIG. 43. A fastener pad 792 is positioned intermediately of the ends of the strap 700 and on the opposite side a complimentary pad 704 is positioned adjacent the outer end of the strap. The strap is used as shown in FIG. 44, with the finger pad 16 grasped as shown in FIGS. 44 and in the same manner as in the previous embodiments. The strap 700 is then wrapped between the thumb and forefinger and over the back of the hand, exposing the pad 792, as shown in FIG. 44. The outer end of the strap 700 is then placed back over the front of the hand and over the base 326 of the strap then back over behind the thumb, with the pad 704 being attached to the receptive pad 792, for holding the wrist strap in position and against the palm of the hand. This embodiment permits the wrist strap to function in much the same manner as the previous embodiments without requiring the wrist flap which secured to the base via the live hinge 64 in the other embodiments.

While certain features and embodiments of the invention have been described herein, it will be readily understood that the invention includes all enhancements and modifications within the scope and spirit of the following claims.

We claim:

1. A strap assembly for securing a bow string release mechanism to an archer's hand in such a manner that the release mechanism may be engaged and operated by the fingers, the strap assembly comprising:

a. a substantially rigid base adapted to be placed in contact with the palm of the hand, the base having opposite ends, one end adjacent the fingers and the other end adjacent the wrist;

b. coupling means supported by the rigid base for securing a bow string release mechanism to the finger adjacent end;

c. an elongate first wrist strap secured to the base and adapted to encircle the wrist;

d. a wrist attachment means on the elongate strap for releasably securing the strap to the archer between the thumb and wrist of the archer's hand; and e. means located between the first wrist strap and the base and adapted for permitting the base to be folded over the strap and away from the palm without first removing the strap from the wrist.

2. The strap assembly of claim 1, further including an enlarged finger pad secured to the base at said finger adjacent edge for supporting one or more fingers of the user when the strap assembly is secured to the hand.

3. The strap assembly of claim 2, wherein said finger pad comprises an elongate cylinder having a receptacle extending radially therein and wherein said base includes a projection adapted to be received in the receptacle for holding the pad relative to the base.

4. The strap assembly of claim 2, wherein said base further includes means for adjusting the position of the finger pad relative to said base.

5. The strap assembly of claim 1, wherein said base further includes means for adjusting the position of the coupling means relative to said base.

6. The strap assembly of claim 1, further including a second strap secured to the base between the opposite ends, said second strap including a free end adapted to be placed between the thumb and forefinger and wrapped about the back of the hand, and fastener means for securing the free end of the strap to the base.

7. The strap assembly of claim 6, wherein said second strap is adapted to be selectively released from said base without releasing said first strap, and wherein there is further included means between the first strap and the base adapted for permitting the base to be folded over the first strap and away from the palm once the second strap is released and without removing the first strap from the wrist.

8. The strap assembly of claim 7, wherein said second strap is adapted to be placed over the base when the base is folded away from the palm of the hand for holding the base in the folded position.

9. The strap assembly of claim 1, wherein said elongate strap includes an outer end and means for securing the outer end directly to the strap.

10. The strap assembly of claim 1, further including an elongate, resilient pad extending outwardly from said wrist adjacent end of the base and adapted for overlying the back of the hand when the base is positioned over the palm, and wherein said strap is secured to said pad.

11. The strap assembly of claim 10, further including fastener means on said pad and a second strap secured to the base between the opposite ends and having a free end adapted to be placed between the thumb and forefinger and wrapped over to the back of the hand for securing the free end to said pad.

12. The strap assembly of claim 1, further including a cushioning, non-stretchable material for covering said base, said material extending beyond the wrist adjacent edge of the base for defining said wrist strap.

13. The strap assembly of claim 12, wherein said cushioning, non stretchable material includes a live hinge adjacent the wrist adjacent edge of said base, whereby the base may be folded relative to the wrist strap.

14. The strap assembly of claim 1, wherein said coupling means comprises a U-shaped bracket having a slot for receiving the base and a universal coupler on the base of the bracket for receiving the bow string release mechanism, and bracket securing means for releasably securing the bracket to the base.

15. The strap assembly of claim 14, wherein said bracket securing means defines a pivot about which said bracket can be pivoted relative to said base.

16. The strap assembly of claim 1, wherein said wrist attachment means comprises a hook and loop type fastener system.

17. The strap assembly of claim 1, wherein said wrist attachment means comprises an elongate, flexible, non-stretchable strap and buckle.

18. A strap assembly for securing a bow string release mechanism to an archer's hand in such a manner that the release mechanism may be engaged and operated by the fingers, the strap assembly comprising:

a. a substantially rigid base adapted to be placed in contact with the palm of the hand, the base having opposite ends, one end adjacent the fingers and the other end adjacent the wrist;

b. coupling means supported by the rigid base for securing a bow string release mechanism to the finger adjacent end;

c. an elongate first strap secured to the base at the wrist adjacent end;

d. attachment means on the strap for releasably securing the strap about the wrist;

e. means located between the strap and the base and adapted for permitting the base to be folded over the strap and away from the palm without first removing the strap from the wrist; and f. an enlarged finger pad secured to the base at said finger adjacent edge for supporting one or more fingers of the user when the strap assembly is secured to the wrist.

19. The strap assembly of claim 18, wherein said coupling means comprises a U-shaped bracket having a slot for receiving the base and a universal coupler on the base of the bracket for receiving any of a plurality of bow string release mechanisms, and bracket securing means for releasably securing the bracket to the base in a manner for permitting the bracket to swing relative to the base.

20. The strap assembly of claim 18, wherein said base further includes means for adjusting the position of the finger pad relative to said base, and means for adjusting the position of the coupling means relative to said base.

21. The strap assembly of claim 18, further including a second strap secured to the base between the opposite ends and having a free end adapted to be placed between the thumb and forefinger and wrapped about the back of the hand, and fastener means for securing the free end of the strap to the base, wherein said second strap is adapted to be selectively released from said base without releasing said first strap, whereby the base may be folded over the first strap and away from the palm once the second strap is released without removing the first strap from the wrist.

22. A strap assembly for securing a bow string release mechanism to the wrist in such a manner that the release mechanism may be engaged and operated by the fingers, the strap assembly comprising:

a. a substantially rigid base adapted to be placed in at least a portion of the palm of the hand, the base having opposite ends, one end adjacent the fingers and the other end adjacent the wrist.

b. coupling means supported by the rigid base for securing a bow strip release mechanism to the finger adjacent end;

c. a cushioning, non-stretchable material for covering said base, said material extending beyond the wrist adjacent end of the base;

d. the extended portion of said cushioning, non-stretchable material defining an elongate wrist strap secured to the base at the wrist adjacent end and adapted to be wrapped around the wrist of the user;

e. wrist attaching means on the wrist strap for releasable securing the wrist strap about the waist; and f. the cushioning, non-stretchable material includes a live hinge for defining means between the wrist strap and the base for permitting the base to be folded over the wrist strap and away from the palm without first removing the wrist strap from the wrist.

23. A strap assembly for securing a bow string release mechanism to the wrist in such a manner that the release mechanism may be engaged and operated by the fingers, the strap assembly comprising:

a. a substantially rigid base adapted to be placed in at least a portion of the palm of the hand, the base having opposite ends, one end adjacent the fingers and the other end adjacent the wrist;

b. coupling means supported by the rigid base for securing a bow string release mechanism to the finger adjacent end;

c. an elongate wrist strap secured to the base at the wrist adjacent ends;

d. a wrist attachment means on the wrist strap for releasable securing the wrist strap about the wrist;

e. means located between the wrist strap and the base adapted for permitting the base to be folded over the wrist strap and away from the palm without first removing the wrist strap from the wrist;

f. an enlarged finger pad comprising an elongate, substantially cylindrical shaped pad with an integral, radially projecting, axially extending mounting plate for securing the pad to the base, the pad for supporting one or more fingers of the user when the strap assembly is secured to the wrist.

24. The strap assembly of claim 23, wherein the cylindrical shaped finger pad is hollow and includes a reinforcing insert therein.

* * * * *